US009109758B1

(12) United States Patent
Yamazaki

(10) Patent No.: US 9,109,758 B1
(45) Date of Patent: Aug. 18, 2015

(54) INFRARED SIGNAL EMITTING APPARATUS

(71) Applicant: Kabushiki Kaisha Kuwagata, Taito-ku (JP)

(72) Inventor: Noriaki Yamazaki, Taito-ku (JP)

(73) Assignee: KABUSHIKI KAISHA KUWAGATA, Tokyo (JP)

( * ) Notice: Subject to any disclaimer, the term of this patent is extended or adjusted under 35 U.S.C. 154(b) by 0 days.

(21) Appl. No.: 14/592,068

(22) Filed: Jan. 8, 2015

(30) Foreign Application Priority Data

Oct. 14, 2014 (JP) ..... 2014-209862

(51) Int. Cl.

| | |
|---|---|
| ***A63J 5/02*** | (2006.01) |
| ***H05B 37/02*** | (2006.01) |
| ***F21L 4/02*** | (2006.01) |
| ***F21K 99/00*** | (2010.01) |
| ***F21V 21/14*** | (2006.01) |
| ***H05B 33/08*** | (2006.01) |
| *F21Y 105/00* | (2006.01) |
| *F21Y 101/02* | (2006.01) |

(52) U.S. Cl.
CPC . *F21K 9/30* (2013.01); *F21V 21/14* (2013.01); *H05B 33/0854* (2013.01); *H05B 37/0227* (2013.01); *F21Y 2101/02* (2013.01); *F21Y 2105/001* (2013.01)

(58) Field of Classification Search
USPC ..... 250/504 R, 526, 338.1, 316.1, 363.01, 250/495.1, 494.1, 552, 553; 315/150, 151, 315/152, 155, 158, 363; 206/223, 573; 362/23.07, 23.08, 23.1, 184, 555, 800; 340/1.1, 2.1, 2.5, 3.52, 3.54, 7.61, 340/815.4, 815.43, 815.45, 815.56, 815.65, 340/815.66, 915.67, 815.68
See application file for complete search history.

(56) References Cited

U.S. PATENT DOCUMENTS

| | | | | |
|---|---|---|---|---|
| 8,963,435 | B2 * | 2/2015 | Yamazaki | 315/158 |
| 2011/0122609 | A1 * | 5/2011 | Dahlin | 362/184 |
| 2013/0250184 | A1 * | 9/2013 | Leclerc et al. | 348/744 |
| 2013/0331002 | A1 * | 12/2013 | Amireh | 446/454 |
| 2014/0184386 | A1 * | 7/2014 | Regler et al. | 340/7.61 |
| 2014/0231625 | A1 * | 8/2014 | Chang et al. | 250/208.1 |
| 2014/0300279 | A1 * | 10/2014 | Yamazaki | 315/158 |

FOREIGN PATENT DOCUMENTS

| | | |
|---|---|---|
| JP | 2004-119068 A | 4/2004 |
| JP | 2012-164439 A | 8/2012 |

* cited by examiner

*Primary Examiner* — Bernard E Souw
(74) *Attorney, Agent, or Firm* — Buchanan Ingersoll & Rooney PC

(57) ABSTRACT

An emitting apparatus emitting infrared ray including control information with respect to a light emitting device which is held by a spectator in a concert venue, and the like. The emitting apparatus includes a light source arranged with a plurality of light emitting diodes, and a front side of the light source is provided with a nozzle having an opening formed in a narrow shape in which a horizontal width is substantially greater than a vertical width. The emitting apparatus is formed such that infrared light is passed through the nozzle to be emitted. This configuration can perform a stage effect having an illumination effect in which, by using the emitting apparatus existing in the concert venue, a band-shaped light emitting area is formed to be moved like a wave.

6 Claims, 19 Drawing Sheets

INFRARED SIGNAL EMITTING APPARATUS

BACKGROUND

1. Technical Field

The present invention relates to an infrared signal emitting apparatus.

2. Background of the Invention

A light emitting system and a light emitting instruction apparatus according to Patent document 1 have been known.

The system and apparatus employ light emitting instruction apparatus which uses infrared ray as a control signal and a light emitting device, which allow to perform a variety of stage effect operations at venues such as a concert. For example, an emitting apparatus (the light emitting instruction apparatus) is used to irradiates an infrared signal from a location where an entire venue can be seen to control light emission of the light emitting devices held by a large number of spectators in the venue.

The light emitting device is controlled by the control signal which includes an ID of the light emitting device so that the light emitting system can perform light emitting control individually with respect to each of the light emitting devices. In addition, as shown in FIG. 18B, the light emitting system allows the light emitting devices which exist solely in an area where infrared ray is irradiated by the emitting apparatus to emit light, thereby a stage effect can be perform in which the spectators can participate in a concert.

RELATED ART

Patent Documents

[Patent document 1] JP 2012-164439 A

SUMMARY OF THE INVENTION

Problems to be Solved

Patent document 1 discloses, as an emitting apparatus used in a light emitting system, a spot-type emitting apparatus configured such that infrared light is irradiated only to a relatively narrow range, and a wide-area type emitting apparatus configured such that the infrared light is irradiated to an entire wide area. These apparatuses allow to control lighting of the light emitting devices existing in a narrow range of a part of a concert venue, or all of the light emitting devices existing in the venue to be lighted simultaneously.

The emitting apparatus described above, however, is incapable of performing a stage effect in which a linear belt-shaped light emitting area (light emission zone) is formed, or the light emission zone of this kind is moved inside the venue, by controlling the light emitting devices arranged (held by the spectators) in an entire wide concert venue. The present invention has been made in view of the circumstances, and an object thereof is to provide an apparatus and a system, which allow to increase variation of the stage effects by controlling the light emitting devices arranged throughout the venue.

Additionally, another object is to provide a structure of an infrared signal emitting apparatus which facilitates change of a width of the light emitting zone.

To achieve the above objects, the present invention has the following configuration. That is, it is an infrared signal emitting apparatus for transmitting a control signal to a light emitting device that is a receiving apparatus, characterized in that the infrared signal emitting apparatus has an emitting apparatus main body for emitting infrared ray including control information to control the light emitting device which emits light based on the received control information. The emitting apparatus main body includes a light source having a plurality of light emitting diodes arranged in a planar manner, the plurality of light emitting diodes generate the control information by emission of the infrared ray. A tubular shaped nozzle provided at a front side of the light source and having an opening formed in a narrow shape in which a horizontal width is substantially greater than a vertical width, and the infrared ray generated by the light source is emitted from the opening of the nozzle.

The present invention makes it possible to shape an irradiation range of the control signal of infrared ray generated by the light source by the nozzle attached to the infrared signal emitting apparatus.

In addition, the infrared signal emitting apparatus according to the present invention is characterized in that the nozzle is detachably attached to the emitting apparatus main body. In the use of the infrared signal emitting apparatus of the present invention, it is required to adjust the irradiation range of the control signal in accordance with size of the venue. In this case, shaping the nozzle to correspond to size and shape of the venue allows an appropriate operation suitable to the venue where the muzzle is used.

In addition, the infrared signal emitting apparatus according to the present invention is characterized in that an adjusting means for adjusting an emitting width of infrared light emitted by the light source is provided on the opening or inside the nozzle.

In addition, the infrared signal emitting apparatus according to the present invention is characterized in that the nozzle is structured to be able to change the length as desired.

Having the configuration described above allows a suitable stage effect corresponding to an event like a concert or the other events, and an operation appropriate to the venue where the infrared signal emitting apparatus is used.

In addition, the infrared signal emitting apparatus according to the present invention further includes a bracket to be used for suspension or placement of the emitting apparatus main body, wherein the emitting apparatus main body is rotatably provided with respect to the bracket, and an attachment angle of the emitting apparatus main body with respect to the bracket can be fixed at an angle selected from a plurality of predetermined angles. The configuration has an advantage to facilitate installation of the infrared signal emitting apparatus and adjustment associated with the installation.

According to the present invention, light emission of light emitting devices held by spectators can be controlled in a wide space, such as a concert venue. Specifically, a direction is possible in which a band-shaped light emitting area is formed inside the venue by the light emission of the light emitting devices and the light emitting area is moved. The present invention has an advantage to obtain the stage effect by the light emission device, which has been conventionally unavailable.

In addition, there is another advantage in which an appropriate operation corresponding to the venue can be performed by forming the nozzle corresponding to a size and shape of the venue.

Further, there is another advantage in which an emission direction of a control signal can be changed or adjusted after an infrared signal emitting apparatus is installed and fixed. A stage effect corresponding to a type of event in a concert or the other events, and an appropriate operation corresponding to the venue to be used are achieved

EMBODIMENTS FOR IMPLEMENTING THE INVENTION

Hereinafter, descriptions will be made of embodiments for implementing the present invention.

Figure 1:
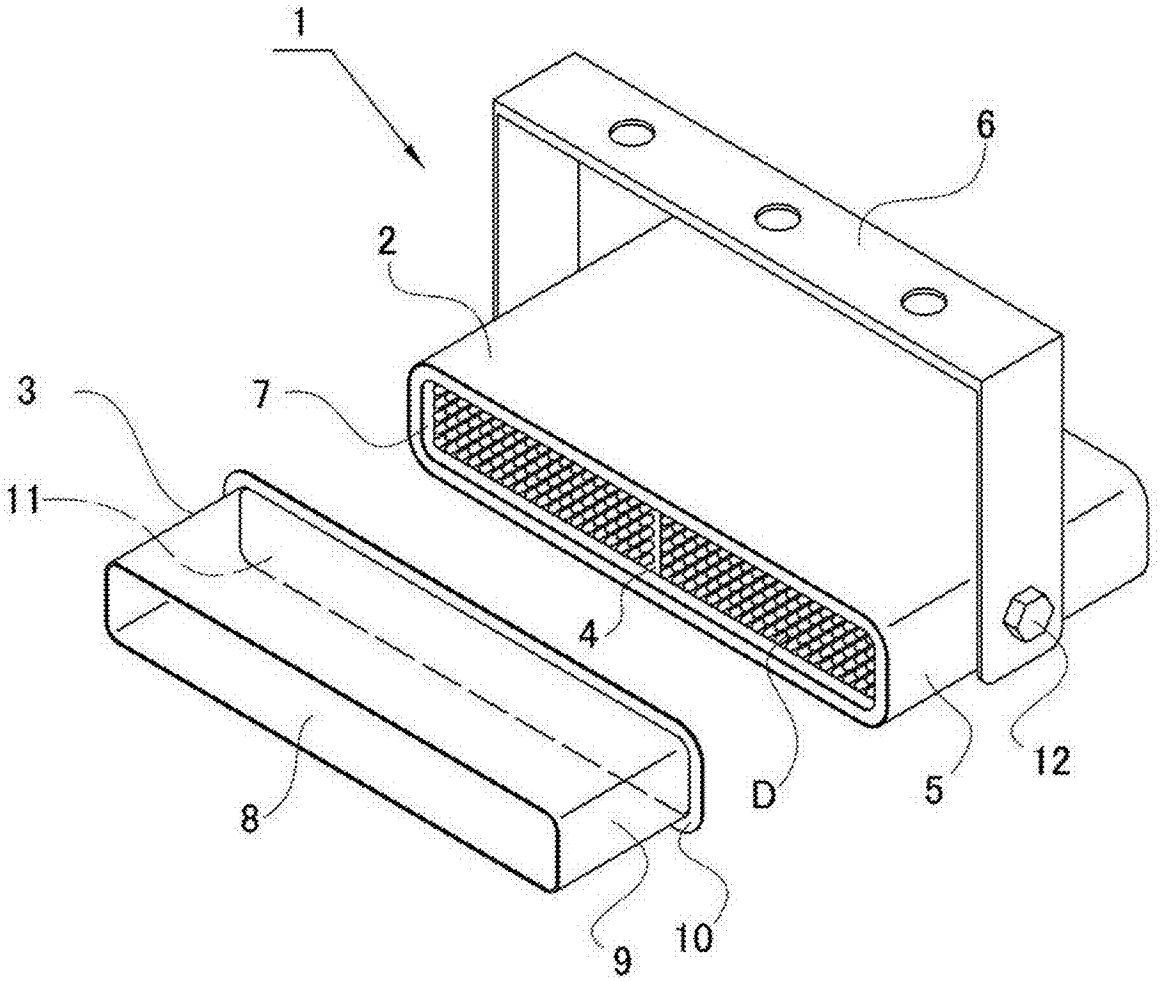
FIG. 1 is an external view of a nozzle and a main body portion forming an example of an infrared signal emitting apparatus according to the present invention.

FIG. 1 shows an external view of an emitting apparatus 1 according to an embodiment. The emitting apparatus 1 includes an emitting apparatus main body 2 incorporating alight source, and a nozzle 3 attached to the emitting apparatus main body 2.

Figure 11:
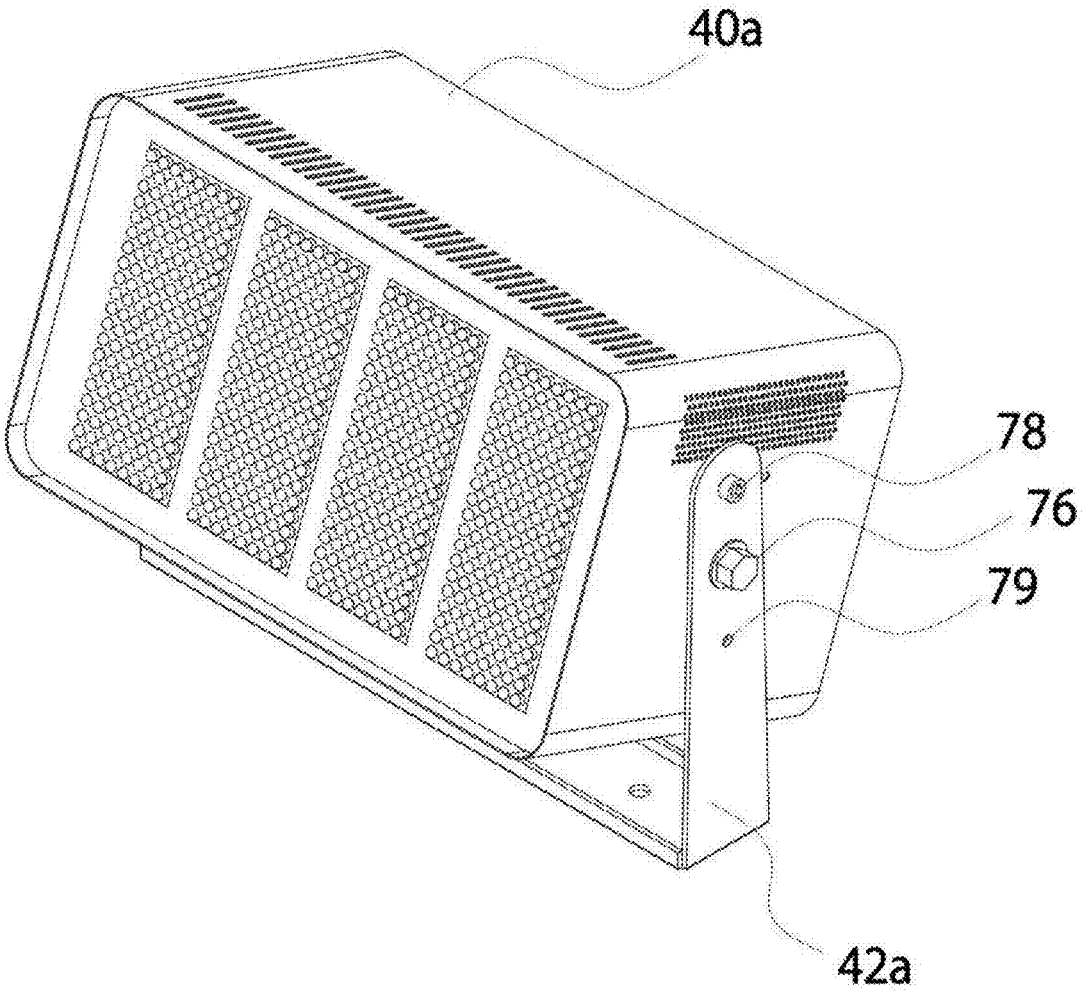
FIG. 11 is an explanatory view relating to another attachment example of the infrared signal emitting apparatus according to the present invention.

The emitting apparatus main body 2 is comprised of the light source 4 in which a plurality of light emitting diodes D is arranged in a planar manner, a drive power source, and a housing 5 for housing them. As an example, the housing 5 of the emitting apparatus main body 2 is provided with a bracket 6 for suspension. The bracket 6 may be used to suspend in a manner as illustrated, or may be used upside down to attach to a tripod placed on a ground in a manner as shown in FIG. 11. The emitting apparatus main body 2 uses a controller 120, a drive control portion 128, and a wave amplifying/shaping means 129, and the like, which will be described later, to perform light emitting control.

The emitting apparatus main body 2 has a light emitting portion having a horizontally elongated opening surface 7. The plurality of light emitting diodes D are arranged in the light emitting portion serving as the light source 4 so as to emit infrared light to a forward direction through the opening surface 7.

The light source 4 is comprised of one or more light emitting plates provided with the plurality of light emitting diodes D which are uniformly arranged at a regular interval vertically and horizontally on a printed circuit board. In the illustrated example, the light emitting plate is formed so that an aspect ratio of an external shape s about 1:2, and two of the light emitting plates are disposed in a horizontal direction to form the light source in a planar shape with an aspect ratio of about 1:4, which horizontal width (length in the horizontal direction) is substantially elongated compared to a vertical width (length in the vertical direction).

As described above, the opening surface 7 of the emitting apparatus main body 2 is formed in the horizontally elongated shape so as to conform to the shape of the light source 4. In addition, each of the light emitting diodes D which constitutes the light source 4 is provided at an inner rearward position of the emitting apparatus main body 2 so as not to project from the opening surface 7. Further, the opening surface 7 may be provided with a transparent cover to protect the light emitting diodes D.

The emitting apparatus main body 2, as described above, having the light source 4 formed in the elongated shape in the horizontal direction, and the light emitting diodes D mounted are arranged in close proximity to the opening surface 7. In case the light emitting diode D has a structure encapsulated in a resin formed in a shell shape, the light emitting diode D has not only high directivity in an emitting direction, but also emits strong infrared light to some extent within a certain angle range around the emitting direction due to a lens effect of the resin covering a light emission part. Accordingly, the infrared light is scattered over a wide range in proportion to the distance to the light emitting device, so that when the emitting apparatus main body 2 described above is used in a large space such as a concert venue, the infrared light is irradiated over the wide range, and the emitting apparatus emits light in the wide range of the venue, based on the same control contents.

According to the embodiment, a nozzle 3 is mounted to the opening surface 7 of the emitting apparatus main body 2 which emits infrared light. The nozzle 3 is structured to have an intermediate portion 9 formed in a duct-like shape to constitute an elongated and narrow front opening 8 on an edge thereof, and an attachment portion 10 formed in a flange shape provided on an outer circumference of a rear end edge of the intermediate portion 9. An attachment portion 10 is mounted to an outer circumference of the front surface portion of the emitting apparatus main body 2 to be fixed with a screw (not shown) or the like. Additionally, an inner circumference portion of the attachment portion 10 is provided with a rear-end opening 11 communicating with the front opening 8 on an edge of the nozzle 3.

When the nozzle 3 shown in FIG. 1 is mounted to the opening surface 7 of the emitting apparatus main body 2, the infrared light generated in the light source 4 is emitted within a range of an emission angle which is determined according to a shape of the rear-end opening 11, a length of the intermediate portion 9, and a shape of the front opening 8.

Figure 13:
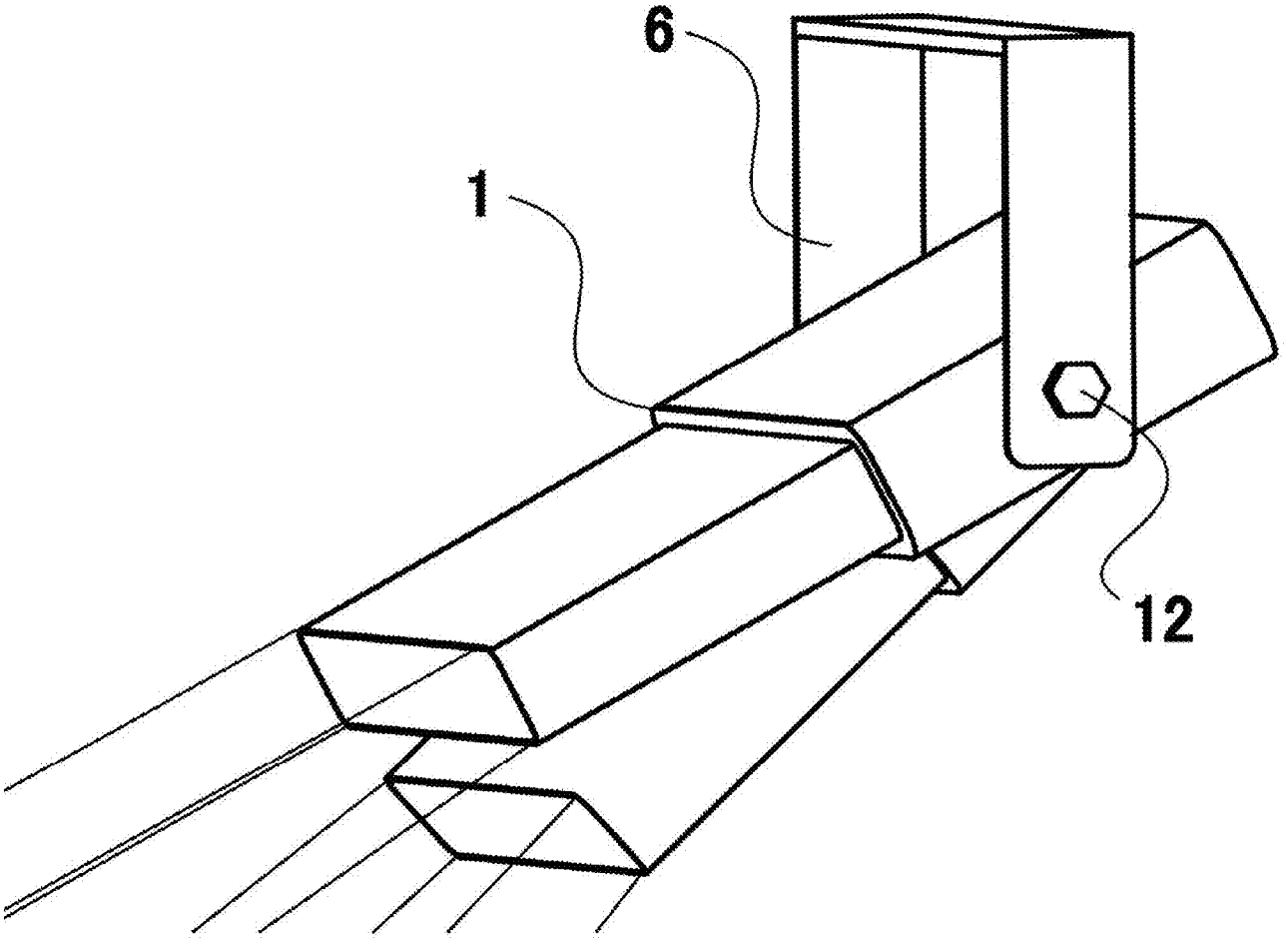
FIG. 13 is an explanatory view showing a usage example of the infrared signal emitting apparatus according to the present invention.
Figure 14:
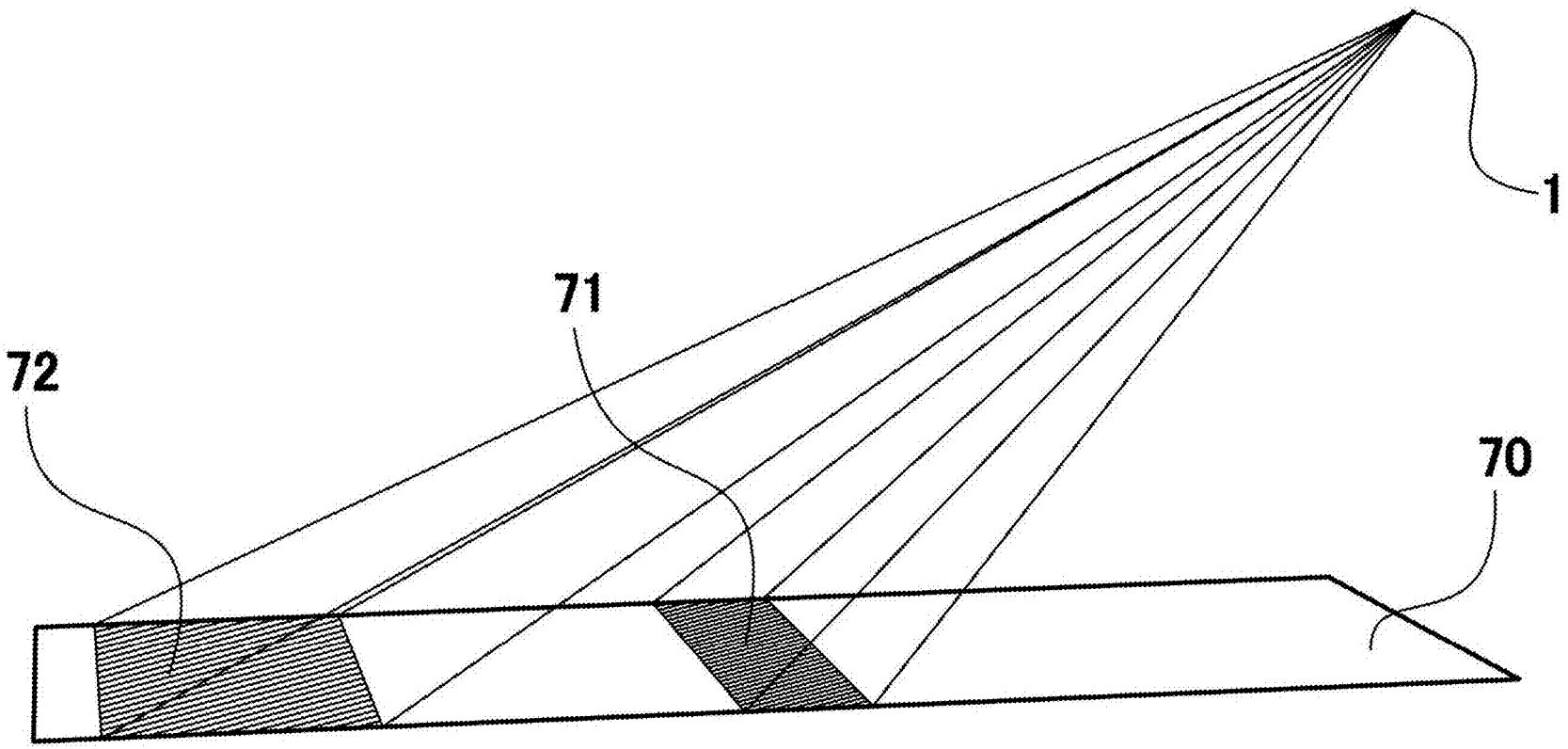
FIG. 14 is an explanatory view of the example of the stage effect using the infrared signal emitting apparatus according to the present invention.

That is, when the emitting apparatus 1 having the nozzle 3 is used to irradiate infrared light from a high position where spectators in the concert venue can be seen downward, the light emitting devices existing in a narrow belt-shaped area in the venue are controlled to emit light. Thereafter, when a direction to which the nozzle 3 of the emitting apparatus 1 faces is moved as shown in FIG. 13, it is possible to move the band-shaped light emitting area formed by light emission of the light emitting device held by the spectators inside the venue, as shown in FIG. 14.

Additionally, in a venue such as a baseball stadium where a playing field is looked down from a surrounding stand, infrared light can be irradiated from the playing field toward the stand to control light emission of the light emitting devices held by spectators surrounding the field. For example, a top and bottom of the emitting apparatus 1 is placed to orient horizontal direction so that a longitudinal direction of the nozzle stands vertical, and infrared ray is emitted toward the stands to circulate the stand, then a light belt produced on the stands can be moved. As the results, a wave of light is created.

There have not been presentation method using a light emitting device of this kind, and the emitting apparatus according to the present invention can provide a novel stage effect and method as described above.

Figure 2:
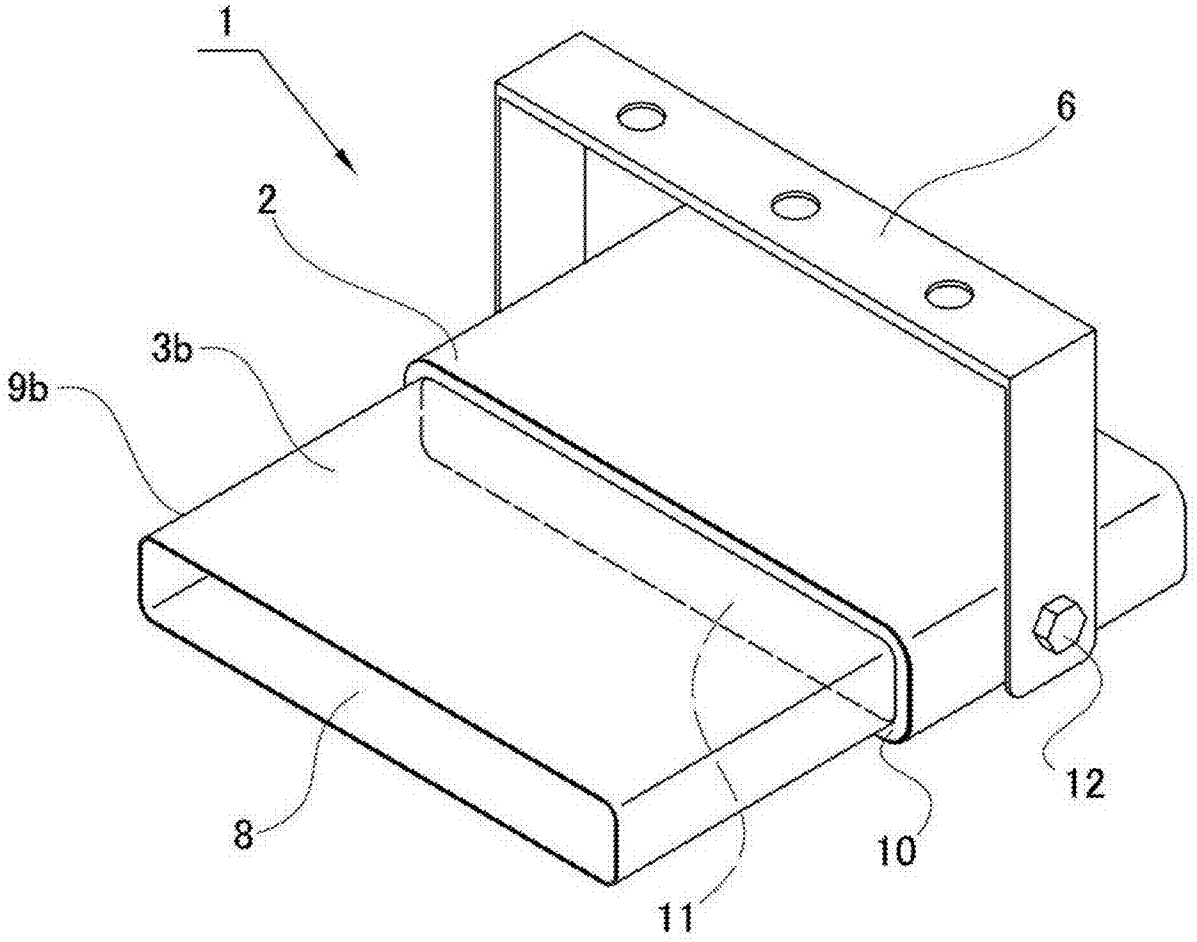
FIG. 2 is an external view showing the example of the infrared signal emitting apparatus according to the present invention.

When a distance between the emitting apparatus 1 and the light emitting device is large, or an irradiation angle is small due to low position of the emitting apparatus 1, a width of an area irradiated by infrared light becomes large. In such cases, a nozzle 3*b* having a long intermediate portion 9*b* and a narrow vertical width, as shown in FIG. 2, is used to irradiate light having high directivity.

In this way, the emitting apparatus main body 2 and the nozzle can be configured to be detachable, such that the nozzle can be exchanged or removed according to the use conditions.

Figure 3:
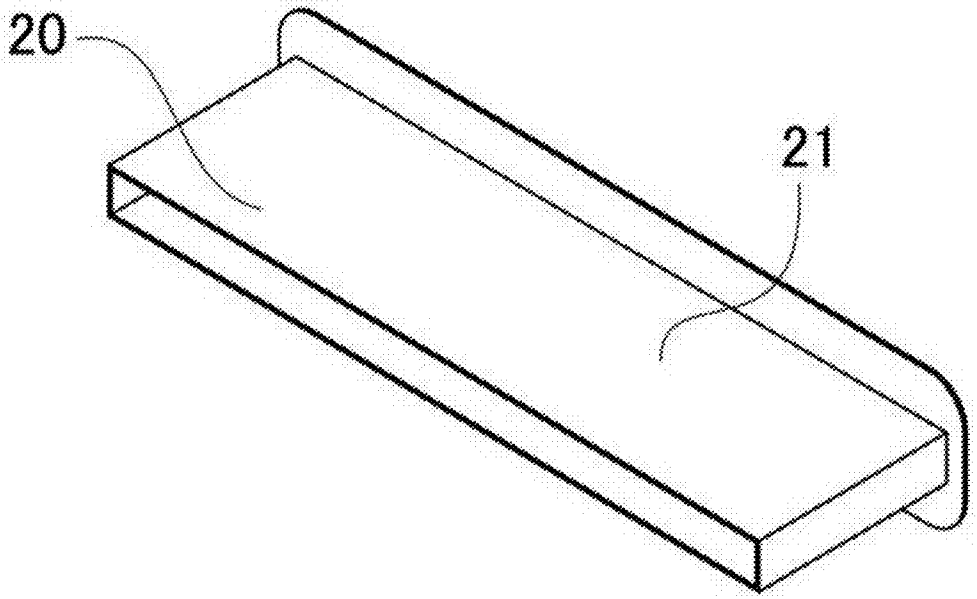
FIG. 3 is an explanatory view relating to another nozzle used for the infrared signal emitting apparatus according to the present invention.

FIG. 3 shows another example of a nozzle formed to be able to detachably mount to the emitting apparatus main body 2. The nozzle 20 shown in FIG. 3 can be mounted to the emitting apparatus main body 2 in place of the nozzle 3. A vertical width of an intermediate portion 21 of the nozzle 20 formed in a duct is formed smaller than that of the nozzle 3. The nozzle 20 makes it possible to narrow a belt-shaped irradiation area irradiated in the venue compared to the irradiation area of the nozzle 3.

Figure 4:
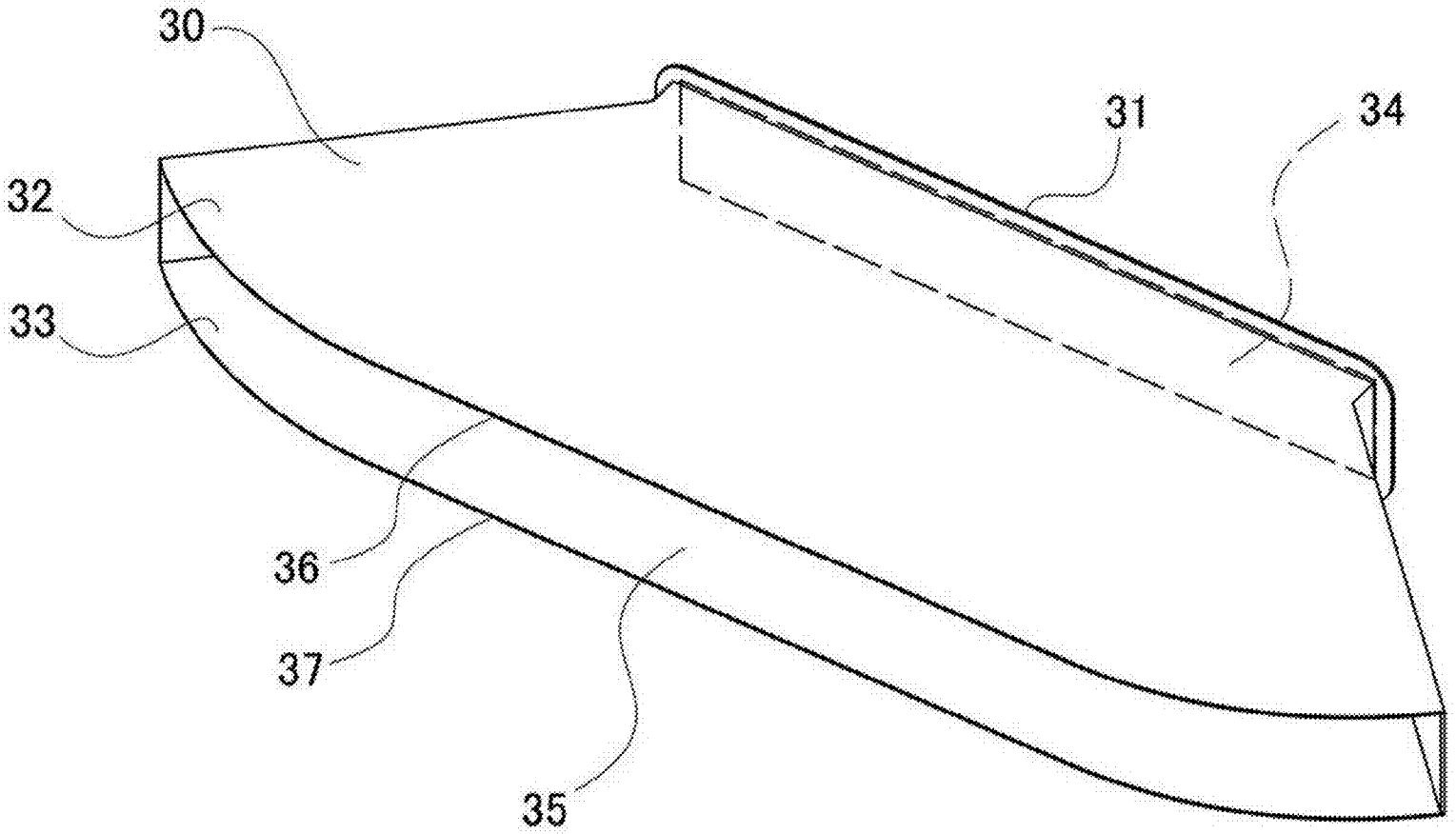
FIG. 4 is an explanatory view relating to another nozzle used for the infrared signal emitting apparatus according to the present invention.

FIG. 4 shows other nozzle 30 mountable to the emitting apparatus main body 2. The nozzle 30 is also formed in a same manner as each of the aforementioned nozzles, which irradiate infrared light having a narrow irradiation width toward the venue.

The nozzle 30 has a mounting portion 31 in a flange shape to be mounted to the emitting apparatus main body 2 and two plate-like hoods 32, 33 having a fan shape spread toward a front side from the mounting portion 31. The hoods 32, 33 are arranged in parallel vertically, and an upper edge and a lower edge of a horizontal elongated hole 34 formed inside the mounting portion 31 are also in parallel. Infrared light passing through the hole 34 passes between the hoods 32 and 33 to be emitted through an edge opening 35.

The left and right portions of the hoods 32, 33 are expanded outwardly at a certain angle (45 degrees as an example) toward a direction to which infrared ray is emitted, and edge portions are closed by side walls. The emission range of an infrared light spreads in a certain angle range is determined according to end edges 36, 37 of the hoods 32, 33 forming the edge opening 35, and the irradiated infrared light is formed into a belt-like shape. Unlike the previously mentioned nozzles, the nozzle 30 can irradiate infrared light also in a horizontal direction.

As described above, the plurality of light emitting diodes D consisting the light source 4 is arranged in the planar manner inside the emitting apparatus main body 2. The nozzle 30 is formed such that a distance to the nearest light emitting diode D inside the light source 4 is substantially identical in any position on the end edges 36, 37. When a shape of the end edges 36, 37 is determined under this condition, the emission angle of direct light of the light emitting diode D can be substantially made constant except for light scattered inside the hood, so that infrared light can be irradiated in a belt shape. Additionally, the nozzle 30 also allows infrared light to be irradiated in the horizontal direction, so that a belt-shaped area where the infrared light is irradiated can be elongated along a longitudinal direction.

Figure 5:
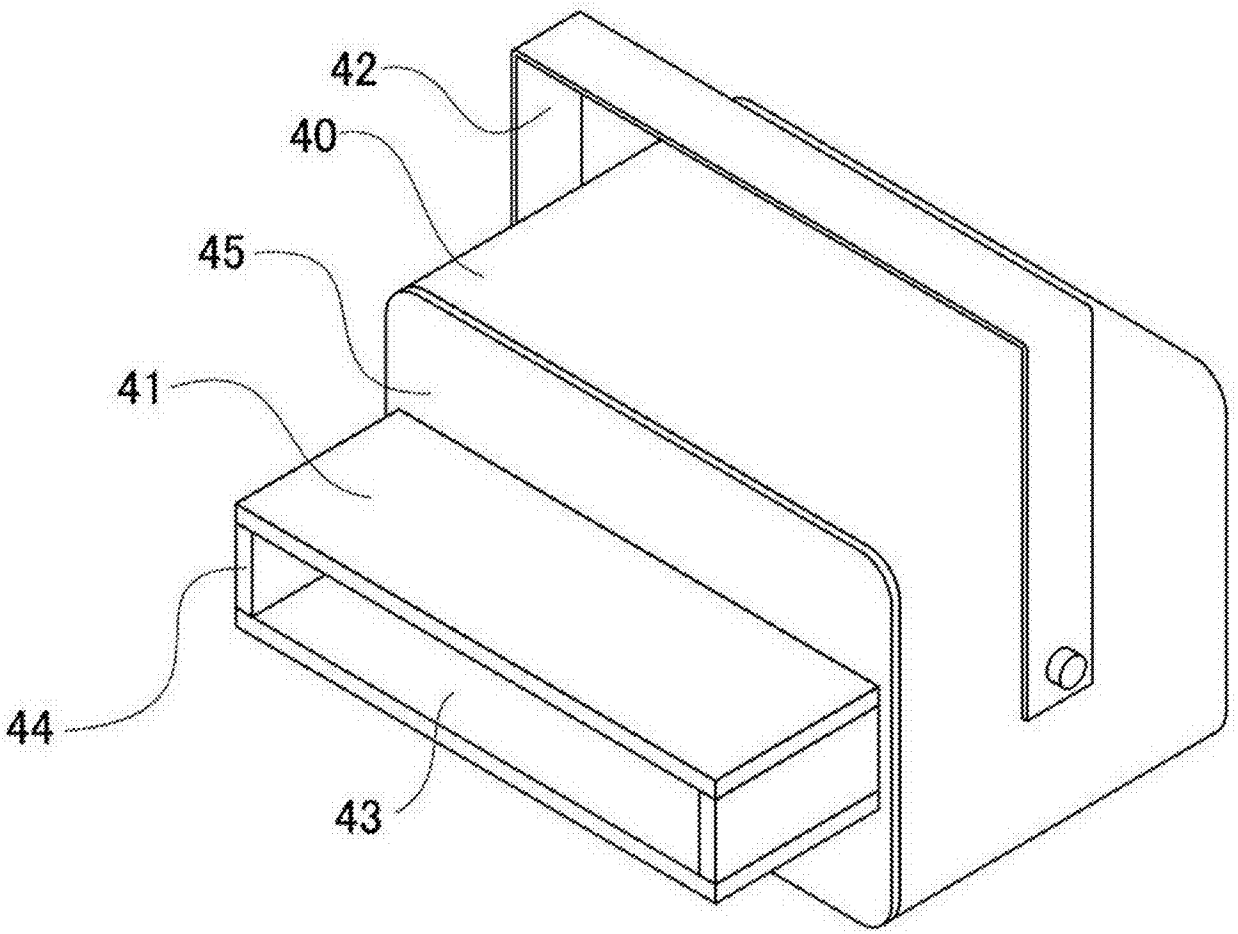
FIG. 5 is an external view showing another example of the infrared signal emitting apparatus according to the present invention.

FIG. 5 shows in which a nozzle 41 for shaping a light beam is mounted to an emitting apparatus main body 40 of a wide-area type which allows infrared ray to reach a long distance.

The emitting apparatus main body 40 includes a housing having a bracket 42 for suspension, and a plurality of light emitting diodes D is arranged in a planar manner adjacent to a front surface portion of the housing. A description on holes provided in the bracket 42 for attachment is omitted.

The number of the light emitting diodes D mounted to the emitting apparatus main body 40 is approximately three times compared to those mounted to the emitting apparatus 1 described above, and while a horizontal width of the emitting apparatus main body 40 is substantially same as that of the emitting apparatus main body 2 described above, a height (vertical width) is greater according to the number of the light emitting diodes D mounted thereto. When the emitting apparatus main body 40 is used alone, it makes it possible to irradiate infrared light over a relatively wide range, in accordance with the directivity of the light emitting diode D.

Figure 6:
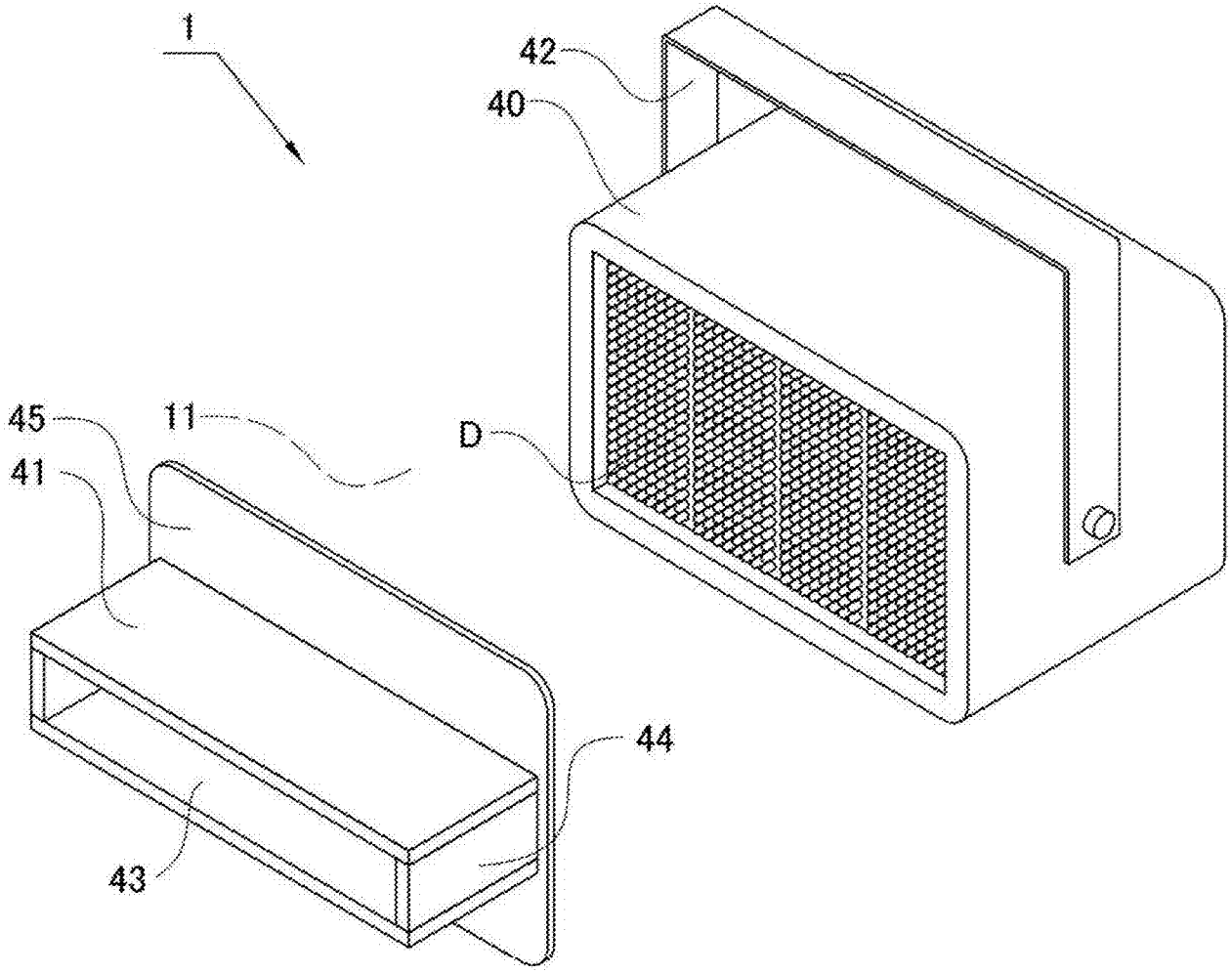
FIG. 6 is an external view of a nozzle and a main body portion configuring the other example of the infrared signal emitting apparatus according to the present invention.

As shown in FIG. 6, a nozzle 41 for shaping the light beam is detachably mounted to a front surface of the emitting apparatus main body 40 irradiating infrared light over a wide range, and the nozzle 41 mounted thereto allows the infrared light (control signal) to be irradiated in a belt-shaped range.

The nozzle 41 consists of a tubular-shaped portion 44 having a rectangular opening 43 with a wide horizontal width and a narrow vertical width, which serves as an emission opening, and a flange-shaped plate body 45 for placing the tubular-shaped portion 44 on the front surface of the emitting apparatus main body 40.

The plate body 45 covers the front surface of the emitting apparatus main body 40, and is attached to a housing of the emitting apparatus main body 40 by an attachment means (not shown), such as a screw or the like. When the plate body 45 is attached to the front surface of the emitting apparatus main body 40, the infrared light emitted by the light emitting diode D is prevented from leaking, so that infrared ray is irradiated only from the opening 43 of an edge of the tubular-shaped portion 44.

FIGS. 7(*a*), 7(*b*) are perspective views explaining an emitting apparatus, different from the aforementioned ones, in which a nozzle 51 is mounted to the emitting apparatus main body 40 of a wide-area type for allowing infrared ray to reach a long distance.

The nozzle 51 shown in FIGS. 7(*a*), 7(*b*), like aforementioned nozzle 41, has a plate body 52 mounted to cover a plurality of light emitting diodes D arranged in the front surface of the emitting apparatus main body 40, and a tubular-shaped portion 53 for shaping a light beam is provided perpendicular to the plate body 52. The plate body 52 to which the tubular-shaped portion 53 is mounted has an opening corresponding to the shape of an inner side of the tubular-shaped portion 53. The shape of the plate body 52 is not limited to a plate-like shape, as far as the plate body 52 has functions to attach the tubular-shaped portion 53 to the emitting apparatus main body 40, and to prevent leakage of the light beam passing through an inside of the tubular-shaped portion 53.

The tubular-shaped portion 53 has an inner tubular body 54 fixed to the plate body 52, and an outer tubular body 55 arranged outside the inner tubular body 54. The outer tubular body 55 is attached to an inner tubular body 54 to allow reciprocating movement in a certain range along the outer circumference of the inner tubular body 54, and the tubular-shaped portion 53 can change the full length by the movement of the outer tubular body 55.

In the illustrated example, a rod-shaped convex portion 57 provided on an inner wall surface of the outer tubular body 55 is movably fitted into a slot 56 provided in both of left and right side surfaces of the inner tubular body 54. With this configuration, the outer tubular body 55 can smoothly move without inclining with respect to the inner tubular body 54.

In addition, a slot 58 is provided in an upper surface of the inner tubular body 54, such that a convex portion 59 provided on a rear end portion of the outer tubular body 55 move inside the slot 58. The slot 58 is provided along a moving direction of the outer tubular body 55, and is ended before reaching an edge of the inner tubular body 54. The convex portion 59 provided on the outer tubular body 55 comes into contact with an edge-side end portion 60 inside the slot 58 in a position where the outer tubular body 55 is maximally projected, so as not to be moved beyond the position. With this configuration, the outer tubular body 55 is prevented from being inadvertently disengaged from the inner tubular body 54. Incidentally, the illustrated example is merely one method how the outer tubular body 55 is moved and is prevented from disengagement, and the present invention is not limited to the example.

Figure 7A:
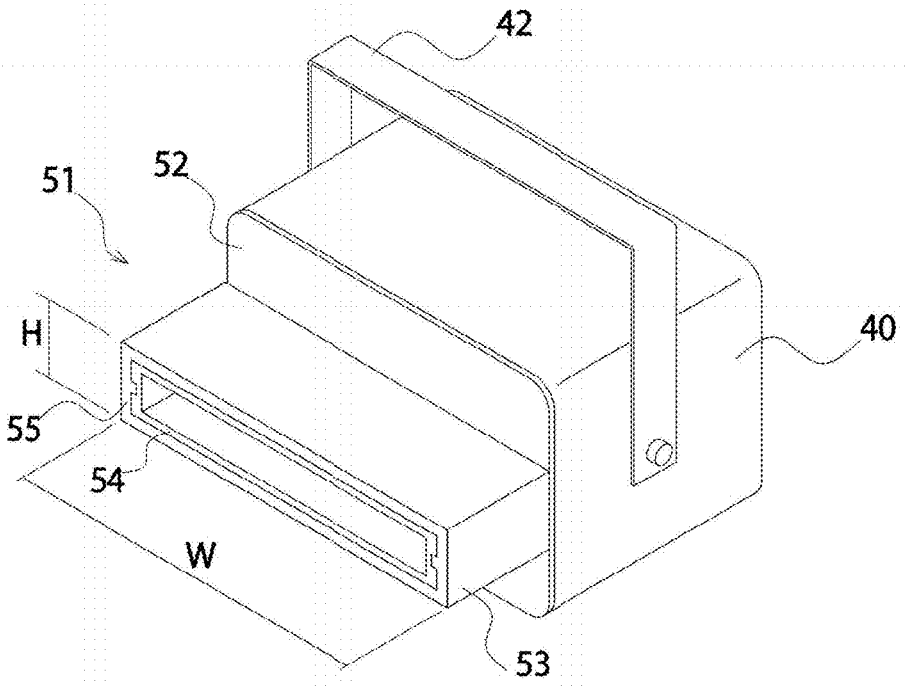
FIG. 7A is an external view showing another example of the infrared signal emitting apparatus according to the present invention.
Figure 7B:
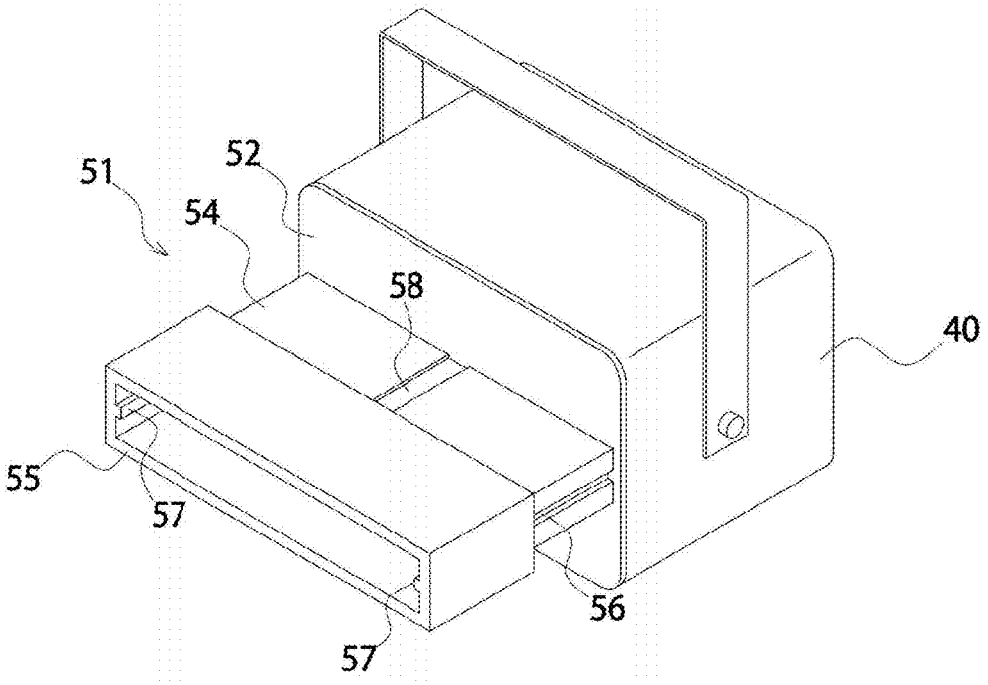
FIG. 7B is an external view showing the other example of the infrared signal emitting apparatus according to the present invention.
Figure 8A:
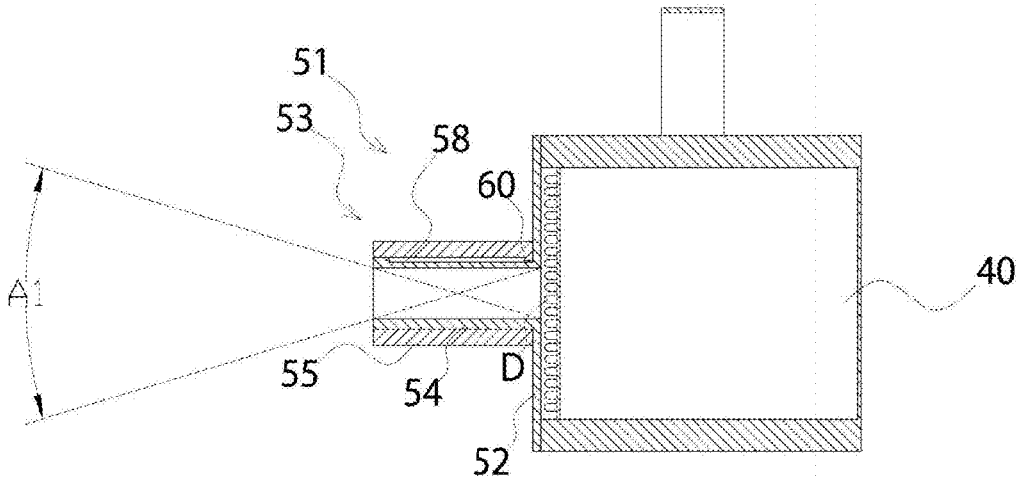
FIG. 8A is an explanatory view relating to the other example shown in FIG. 7A.
Figure 8B:
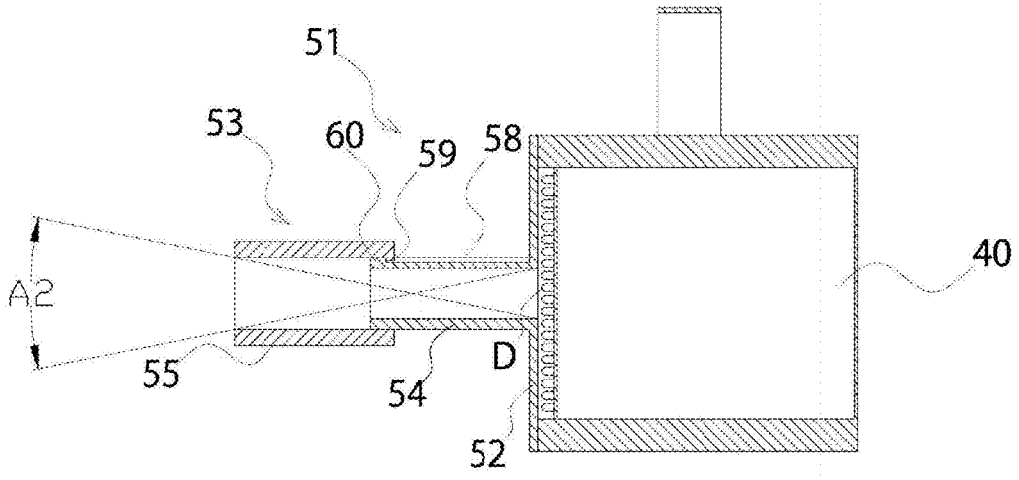
FIG. 8B is an explanatory view relating to the other example shown in FIG. 7B.

The states of FIGS. 7A, 7B are shown in FIGS. 8A, 8B, respectively, which are cross-sectional views omitting an internal mechanism of the emitting apparatus main body 40. Changing the full length of the tubular-shaped portion 53 varies an irradiation allowable angle (irradiation range) of the infrared light irradiated from an opening of an edge of the tubular-shaped portion 53.

Since the tubular-shaped portion 53 shown in the figures has a rectangular tubular body having a low height (narrow vertical width H) and a wide horizontal width W (refer to FIGS. 7A, 7B), the irradiation allowable angle varied by elongating the full length of the tubular-shaped portion 53 is likely to become smaller in a direction of the narrow vertical width H than that in a direction of the wide horizontal width W. When the tubular-shaped portion 53 is short, the irradiation allowable angle is A1 shown in FIG. 8A. On the other hand, when the tubular-shaped portion 53 is elongated, the irradiation allowable angle is A2 shown in FIG. 8B to become smaller than A1 described above. Therefore, changing the irradiation allowable angle is to change a shape and size of an area where infrared ray is irradiated.

The infrared ray irradiated from the emitting apparatus main body 40 is not visible light for lighting, but a control signal to control the light emitting device which will be described later. As described above, changing the irradiation range of the infrared ray is to change, as desired, the shape and size of the area on which the control signal is effectively acted. That is, changing the full length of the tubular-shaped portion 53 allows a selected range of a large number of the light emitting devices existing in an entire area to be changed as desired.

Incidentally, the full length of the tubular-shaped portion 53 may be changed, during an event, such as a concert and the like, for example, or may be fixed after being adjusted such that the control signal can be irradiated with respect to an area having a certain width or size. While, in the aforementioned example, the tubular-shaped portion 53 is configured with two tubular bodies of the inner tubular body 54 and the outer tubular body 55, the number of the tubular bodies to be combined is not limited to two pieces thereof. Further, a shape of the tubular body is not limited to a simple cubic shape, and a shape of the opening of the edge is not limited to a rectangle. In addition, the tubular-shaped portion 53 may be configured such that the inner tubular body 54 is moved with respect to the fixed outer tubular body 55, in an opposite manner of the aforementioned example.

Figure 9:
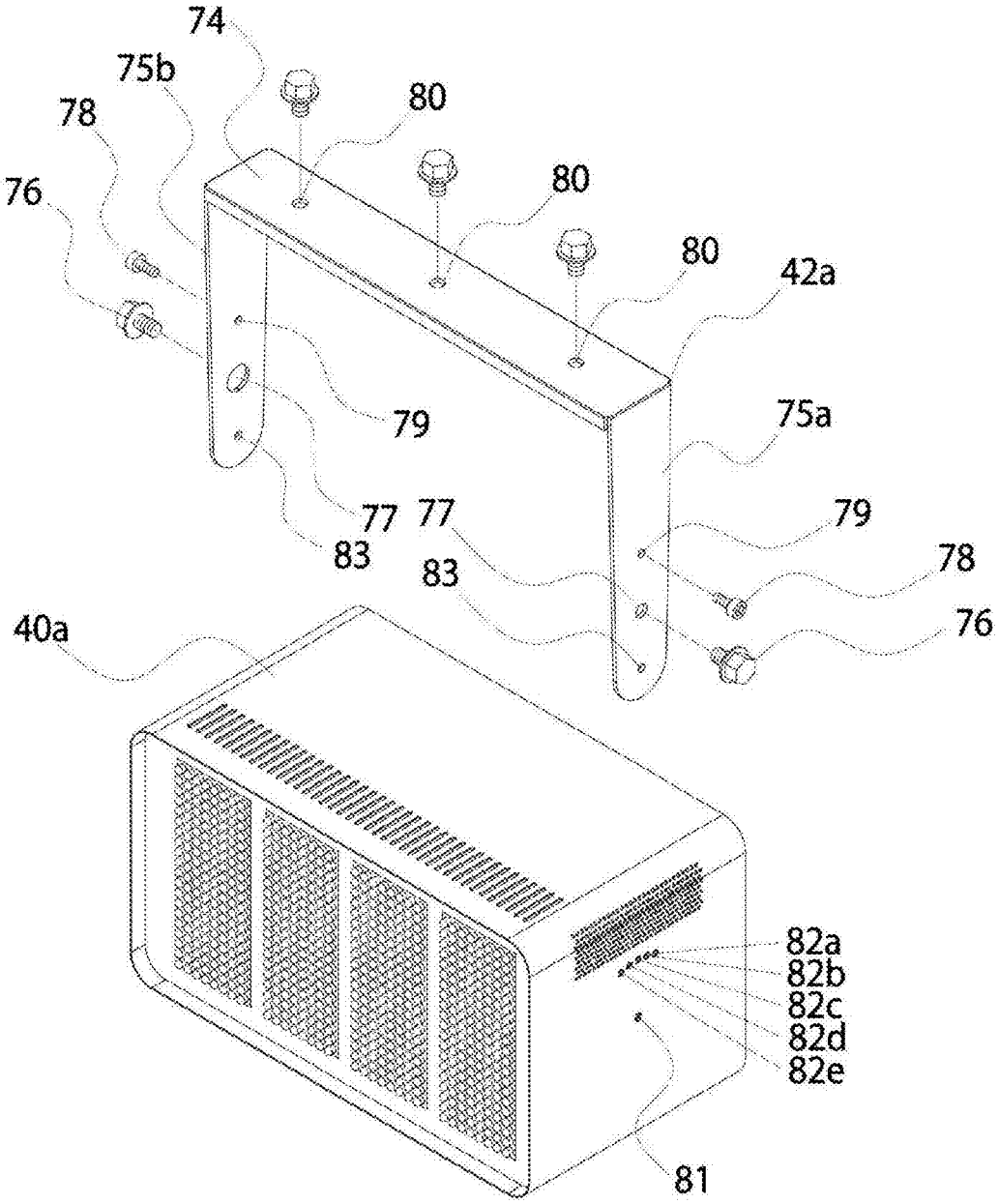
FIG. 9 is an explanatory view relating to another example of the infrared signal emitting apparatus according to the present invention.

FIG. 9 is an explanatory view of an emitting apparatus main body 40*a* having similar functions of the emitting apparatus main body 40. The emitting apparatus main body 40*a* has also a bracket 42*a* similar to the aforementioned ones. The bracket 42*a* is a U-shaped metallic part having an attachment portion 74 for fixing the emitting apparatus main body 40*a* to another structure, a tripod, or the like, and plate-shaped arm portions 75*a*, 75*b* provided at left and right of the attachment portion 74. The bracket 42*a* has a hole 77 inserting a bolt 76, and a hole 79 inserting a screw 78 for maintaining an angle, on the arm portions 75*a*, 75*b*, respectively. The hole 79 is provided between the hole 77 and the attachment portion 74. Additionally, the attachment portion 74 having the arm portions 75*a*, 75*b* on both ends has a plurality of holes 80 to be used for fixing to the other structure, the tripod, or the like.

Incidentally, while the nozzles 41, 51 described above are omitted in the figure, the emitting apparatus main body 40*a* may be used in a state where the nozzles 41, 51 are omitted, or may be used with the nozzles 41, 51 mounted thereto.

There is provided a screw hole 81 coupled with the bolt 76 which is inserted into the hole 77 of the bracket 42*a* in left and right side surfaces of the emitting apparatus main body 40*a*, respectively. In addition, in an upper side of the screw hole 81, there are provided a plurality of screw holes 82 (82*a*, 82*b*, 82*c*, 82*d*, 82*e*, five holes as an example) arranged on a circumference around the screw hole 81 as a center at a constant angular interval (10 degrees as an example). The screw hole 82 is provided in a position corresponding to the hole 79 provided in an upper side of the hole 77 of each of the arm portions 75*a*, 75*b*. Each of the arm portions 75*a*, 75*b* is rotated about the screw hole 81, and thereby a position of the hole 79 matches any one of the screw holes 82*a*, 82*b*, 82*c*, 82*d*, 82*e*.

When the bracket 42*a* is fixed to the other structure, the tripod, or the like, the screw 78 inserted into the hole 79 of each of the arm portions 75*a*, 75*b* can be coupled with any one of the screw holes 82*a*, 82*b*, 82*c*, 82*d*, 82*e*. With this configuration, the emitting apparatus main body 40*a* can be fixed at an angle selected from predetermined angles (every 10 degrees in the illustrated example), and can be fixed after an emission direction of the infrared signal is adjusted.

Each of FIGS. 10A, 10B, 10C, 10D is an explanatory view showing that a posture of the emitting apparatus main body 40*a* varies according to a positional relationship between the hole 79 (screw 78) provided in the bracket 42*a*, and the screw hole 82 (82*a*, 82*b*, 82*c*, 82*d*, 82*e*) corresponding to the hole 79.

Figure 10B:
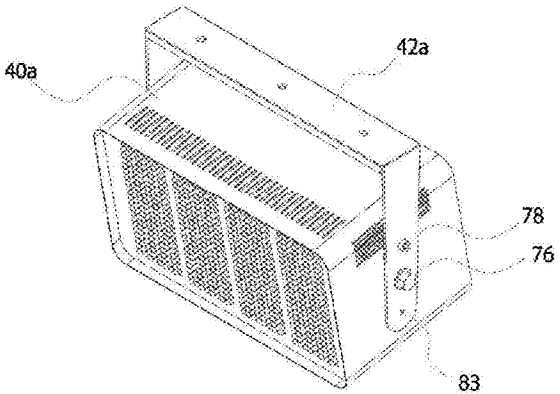
FIG. 10B is an explanatory view relating to the attachment example of the infrared signal emitting apparatus according to the present invention.
Figure 10A:
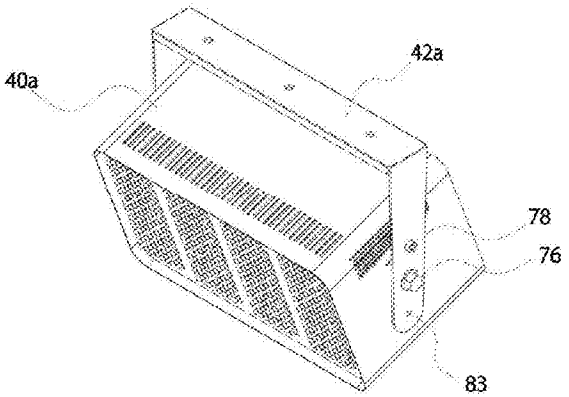
FIG. 10A is an explanatory view relating to an attachment example of the infrared signal emitting apparatus according to the present invention.

When the hole 79 is made to correspond to the screw hole 82*a* to be fixed with the screw 78, the emitting apparatus main body 40*a* is fixed in a state of facing downward from a horizontal direction (−20 degrees with respect to the horizontal, in the illustrated example) in the emission direction of the infrared signal, as shown in FIG. 10A.

When the hole 79 is made to correspond to the screw hole 82*b* to be fixed with the screw 78, the emitting apparatus main body 40*a* is fixed in a state of facing slightly downward from the horizontal direction (−10 degrees with respect to the horizontal, in the illustrated example) in the emission direction of the infrared signal, as shown in FIG. 10B.

Figure 10D:
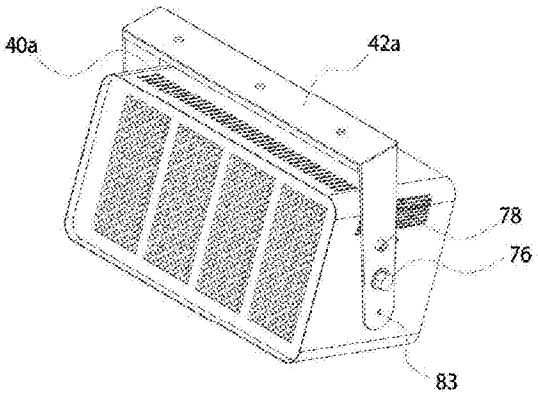
FIG. 10D is an explanatory view relating to the attachment example of the infrared signal emitting apparatus according to the present invention.
Figure 10C:
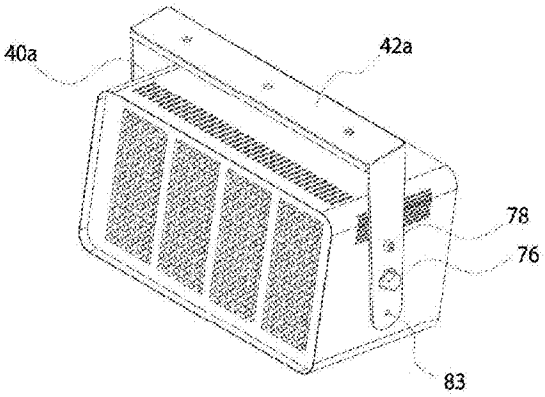
FIG. 10C is an explanatory view relating to the attachment example of the infrared signal emitting apparatus according to the present invention.

When the hole 79 is made to correspond to the screw hole 82*d* to be fixed with the screw 78, the emitting apparatus main body 40*a* is fixed in a state of facing slightly upward from the horizontal direction (10 degrees with respect to the horizontal, in the illustrated example) in the emission direction of the infrared signal, as shown in FIG. 10C.

When the hole 79 is made to correspond to the screw hole 82*e* to be fixed with the screw 78, the emitting apparatus main body 40*a* is fixed in a state of facing upward from the horizontal direction (20 degrees with respect to the horizontal, in the illustrated example) in the emission direction of the infrared signal, as shown in FIG. 10D.

Additionally, as shown in FIG. 11, it is also possible that the attachment portion 74 is disposed under the emitting apparatus main body 40*a* to attach the bracket 42*a* such that each of the arm portions 75*a*, 75*b* faces upward. Each of the arm portions 75*a*, 75*b* of the bracket 42*a* is provided with a hole 83 other than the hole 79 described above. The hole 83 is provided between the hole 77 inserting the bolt 76 by which the emitting apparatus main body 40*a* and bracket 42*a* are coupled with each other, and an edge of each of the arm portions 75*a*, 75*b*.

In the infrared signal emitting apparatus according to the present invention, the bracket 42*a* can be disposed under the emitting apparatus main body 40*a*, as shown in the figure. Additionally, in a same manner as the aforementioned example, the hole 83 and the screw hole 82 (82*a*, 82*b*, 82*c*, 82*d*, 82*e*) are used to allow the emitting apparatus main body 40*a* to be fixed at a constant angle.

Figure 12:
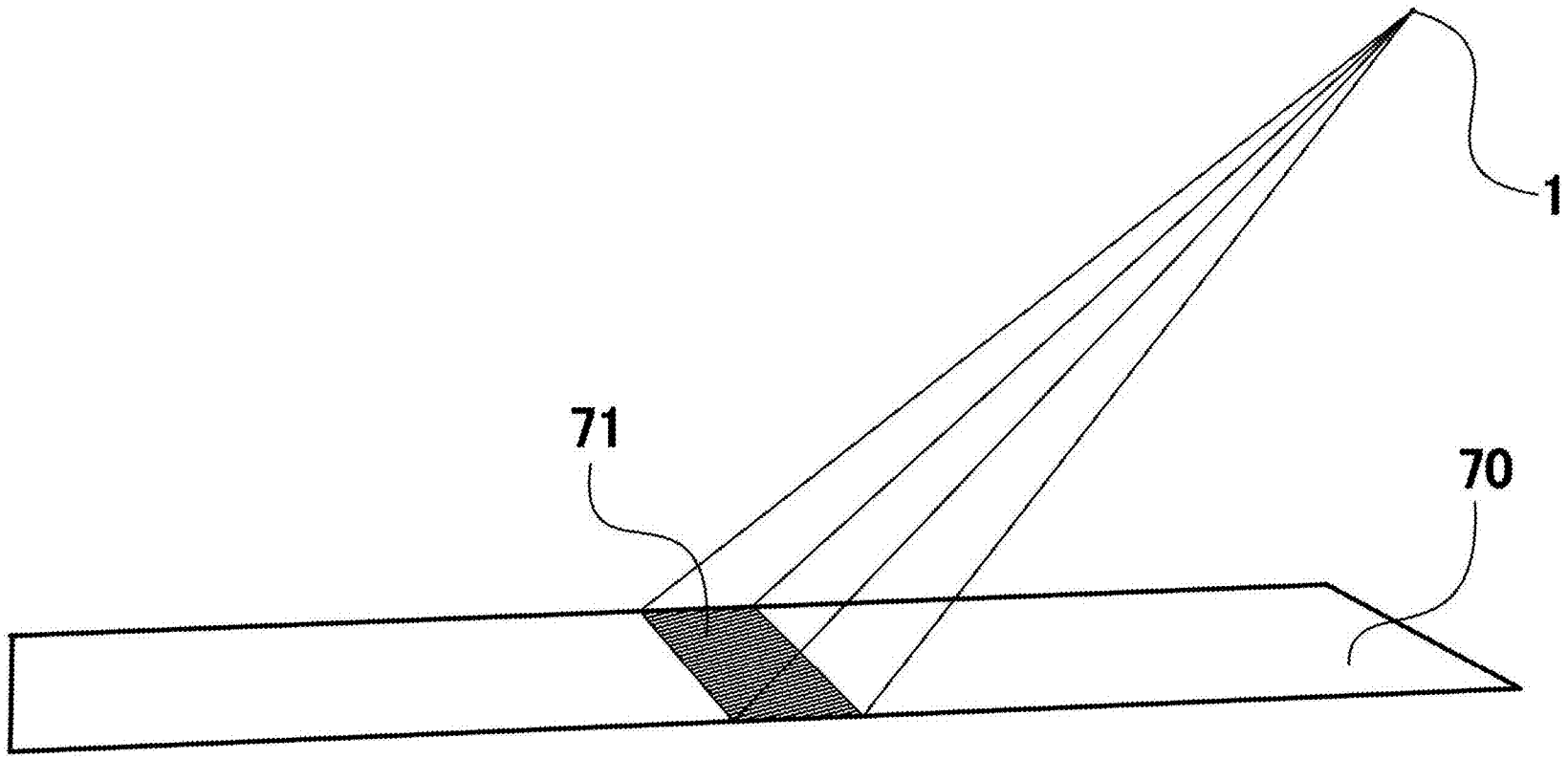
FIG. 12 is an explanatory view of an example of a stage effect using the infrared signal emitting apparatus according to the present invention.

FIG. 12 is an explanatory view showing an image of a usage state of the emitting apparatus 1, showing a state where the emitting apparatus 1 is used to irradiate infrared light narrowed to a constant width from an oblique upward direction of a wide area surface 70 representing a concert venue.

FIG. 13 is an explanatory view of a usage state of the emitting apparatus 1 (same as the emitting apparatus main body 40 with the nozzle 41 attached thereto), showing a state where an edge of the nozzle 3 of the emitting apparatus 1 is vertically rotated about the attachment portion 12 of the fixed bracket 6. In addition to the case where the rotation of the emitting apparatus 1 is carried out by a manually direct operation, a motor with encoder may be attached to control the rotation thereof such that a rotation angle can be controlled. In avenue having a large horizontal width, a plurality of the emitting apparatuses 1 are arranged on a straight line at regular intervals to be synchronizingly rotated. This arrangement can form a linear, elongated irradiation area without interruption halfway through, even in the venue having the large horizontal width. In addition, a posture control of the emitting apparatus 1 may be performed by using an operation program so as to be synchronized with other lighting equipment and sound equipment.

When the emitting apparatus 1 irradiates the wide area surface 70, a belt-shaped irradiation area 71 is formed on the wide area surface 70. Thereafter, when an edge of the emitting apparatus 1 is rotated upward, the irradiation area 71 on the wide area surface 70 is moved in a direction of an irradiation area 72 continuously, as shown in FIG. 14, and when the edge of the emitting apparatus 1 is rotated downward again, the irradiation area is moved in a direction of the irradiation area 71. Accordingly, when the edge of the emitting apparatus 1 is rotated vertically, the belt-shaped irradiation area formed on the wide area surface 70 is moved.

In the belt shaped area on the wide area surface 70 irradiated with infrared ray, a large number of light emitting devices are arranged, which emit light with the control signal included in the irradiated infrared ray. Specifically, a large number of spectators holding the light emitting devices are positioned on the wide area surface, which is audience seats of the concert venue.

Figure 15A:
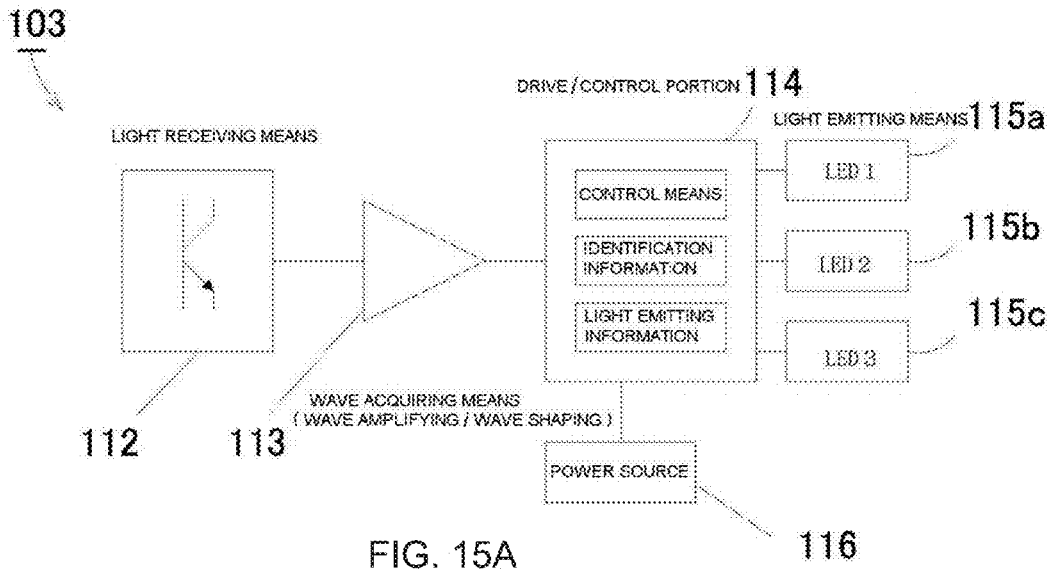
FIG. 15A is an explanatory view of a light emitting device used in the present invention.
Figure 15B:
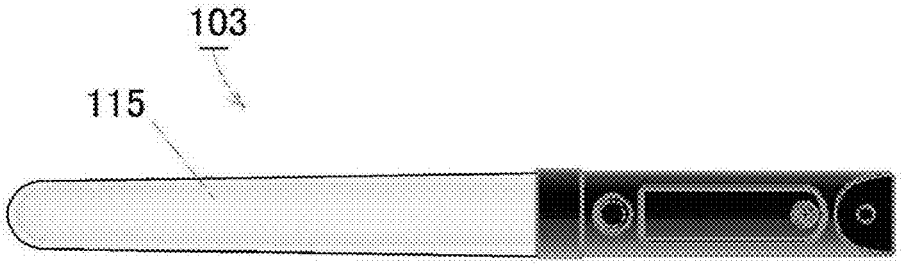
FIG. 15B is an explanatory view of the light emitting device used in the present invention.

Next, a description will be made on a light emitting device 103 controlled by the emitting apparatus 1. FIG. 15(*a*) is a schematic block diagram of the light emitting device 103, and FIG. 15(*b*) shows a structural diagram of the light emitting device 103. As major structural components, the light emitting device 103 includes a light receiving means 112, a wave acquiring (wave amplifying/shaping) means 113, a drive control portion 114, alight emitting means 115 (115*a*, 115*b*, 115*c*), and a power source 116.

The light receiving means 112 is formed with a light receiving element, such as a photo diode, and can receive infrared light (a control signal) output by the emitting apparatus emitting the infrared ray. The wave acquiring (wave amplifying/shaping) means 113 adjusts the infrared light received by the light receiving means 112 so as to have a voltage of a predetermined level, and shapes a wave form to serve as an extracting means which extracts a control code from a modulated signal.

The drive control portion 114 controls each electric means included in the light emitting device 103, and serves as a means to perform drive control for making the light emitting means 115 emit light, mainly based on the control code. The light emitting means 115 is formed with light sources, such as LEDs which emit visible light, and is configured with the LEDs (115*a*, 115*b*, 115*c*) emitting light in red, blue, and green, respectively, in this embodiment. Incidentally, the light emitting device has a variety of forms, such as a bracelet type, a pendant type, and the like, to be worn on a body, and the form thereof is not limited to a pen type.

Figure 16:
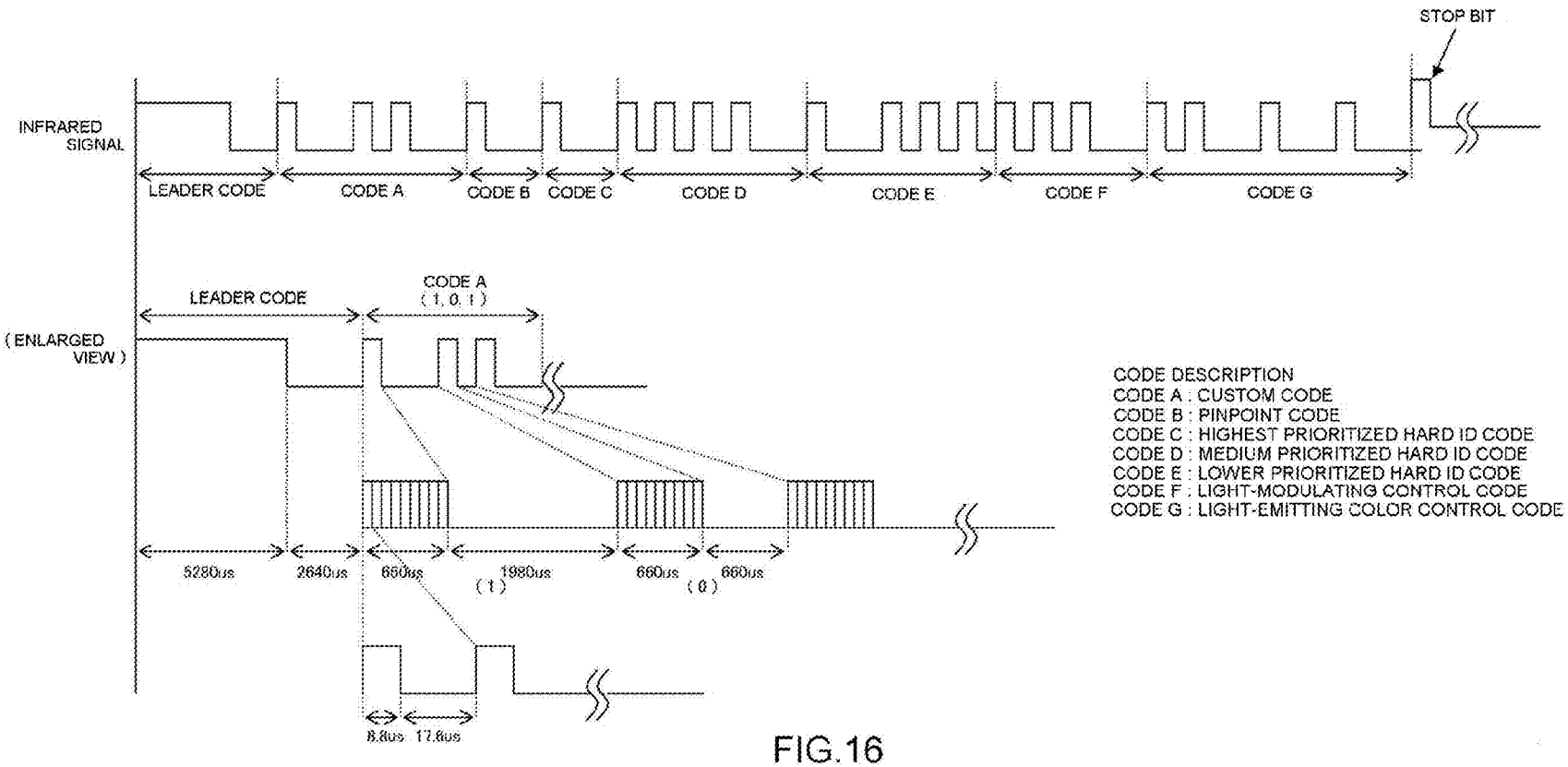
FIG. 16 is an explanatory view relating to contents of an infrared signal.

Next, a description will be made of the control code included in the control signal. The control code is included in the infrared signal transmitted by the emitting apparatus. FIG. 16 shows an example of the control code included in the infrared signal. The first row in FIG. 16 shows an example of the control codes included in the infrared signal, the second row is an explanatory view in which portions of a leader code and a code A are enlarged in a time axis direction, the third row is an explanatory view in which the portions of the leader code and the code A shown in the second row are further enlarged in the time axis direction, and the fourth row shows the minimum pulse width of the emitted infrared signal.

As shown in FIG. 16, the infrared signal includes the leader code, seven codes indicated as codes A to G, and a stop bit, as the control codes. The leader code and the stop bit are codes to be recognized as a beginning and an end of the control code, respectively. Each code arranged between the leader code and the stop bit serves as a control instruction for driving the light emitting device 103.

The code A is a custom code. This code is a verification code unique to a manufacturer to identify a product of the own company (manufacturer). The verification code verifies whether or not to be consistent with a code stored in the light emitting device 103. Only when they are consistent, the other control codes are accepted by the light emitting device 103 as instructions. The verification code also serves to manage manufacturing time and the like.

The code B is a pinpoint code. This code is a verification code indicating a type of the emitting apparatus, and determines whether or not to be consistent with the ID code included in the light emitting device 103.

The light emitting device 103 according to this embodiment can be used with a spot-type emitting apparatus, different from the aforementioned one, configured so as to irradiate infrared light only to a relatively narrow range, and a wide-area type emitting apparatus, such as the aforementioned one, configured so as to irradiate infrared light over a wide area. With this code, the infrared signal allows a type of emitting apparatus to be recognized.

The codes C to E are hard ID codes. These codes are preliminary stored in the light emitting device 103 as needed, to verify whether or not to be consistent with the transmitted codes C to E. When they are consistent, an individual control can be executed, such as changing to a specific operation mode, disregarding or executing a specific control signal, or the like. These codes can be used in various ways in which, for example, the codes may be assigned by client, talent, or other purposes to use the light emitting device 103 in different manners, and, when the same hard ID codes are received in a same manner as a terminal ID, the LEDs emit light according to instructions of control data for emitting and modulating light.

The codes F and G are an emission control code and a light-modulating control code, respectively. These codes control the emission speed of the LEDs 115*a*, 115*b*, 115*c* in three colors, which are mounted to the light emitting device 103, by repeating light-emitting and light-off signals.

Next, a description will be made of a main operation of the light emitting device 103 which receives the infrared signal, with reference to the flow chart shown in FIG. 17.

When a power switch of the light emitting device 103 is turned on, the LEDs 115*a*, 115*b*, 115*c* are lighted or blinked with an emission pattern which is stored so as to be operated at the time of no signal (S1), and the infrared signal becomes in a receivable state by the light receiving means 112.

When the infrared signal is received, the control code is extracted by the wave acquiring means 113, and the drive control portion 114 determines whether or not the code A included in the signal is consistent with the verification codes included in an identification information which is stored in the light emitting device 103 (S2). The verification codes include the codes A and C to E outputted by the emitting apparatus. As a result of determination, when the extracted control code does not include the code A (is inconsistent with the identification information stored in the light emitting device 103), the process returns to the receivable state of the infrared signal (S1). When the code A is consistent with the identification information stored in the light emitting device 103, the contents of the code B are determined as a next step (S4).

In the embodiment, the code B indicates either one of "1" and "0 (other than 1)". When the code B is "1", the emitting apparatus is determined as the "spot type", and, when the code B is "other than 1", the emitting apparatus is determined as other than the "spot type" ("wide-area type" in the present embodiment).

In the case of "the code B=1," after storing a current emission color and modulated light value in a storage area inside the drive control portion 114 (S5), the LEDs (115*a*, 115*b*, 115*c*) are made to emit light according to the contents specified by the code G serving as an emission color control code (S6). Then, a timer is set for 0.5 second concurrently with the emission (S7), a set time set by the timer is counted, and each of the LEDs is made to emit light based on the emission color and modulated light value stored at the step S5 with the lapse of the set time (S9). After the step S9, the process returns again to the receivable state of the infrared signal (S1).

According to the embodiment, the timer time set to 0.5 second is a fixed data preliminarily stored in the light emitting device 103. During a certain period of time where the timer is effective, light is emitted according to the contents based on other control codes transmitted together with the code B=1. During this certain period of time, no interrupt is permitted even if the control signal is transmitted from the light emitting instruction apparatus.

While the timer time is set to be a fixed value, the light emitting device may be provided with an adjusting means so as to set a desired period of time. In addition, the light emitting instruction apparatus may transmit a signal for setting a timer time together with the control code "the code B=1," to perform a timer operation according to the transmitted set time.

Figure 17:
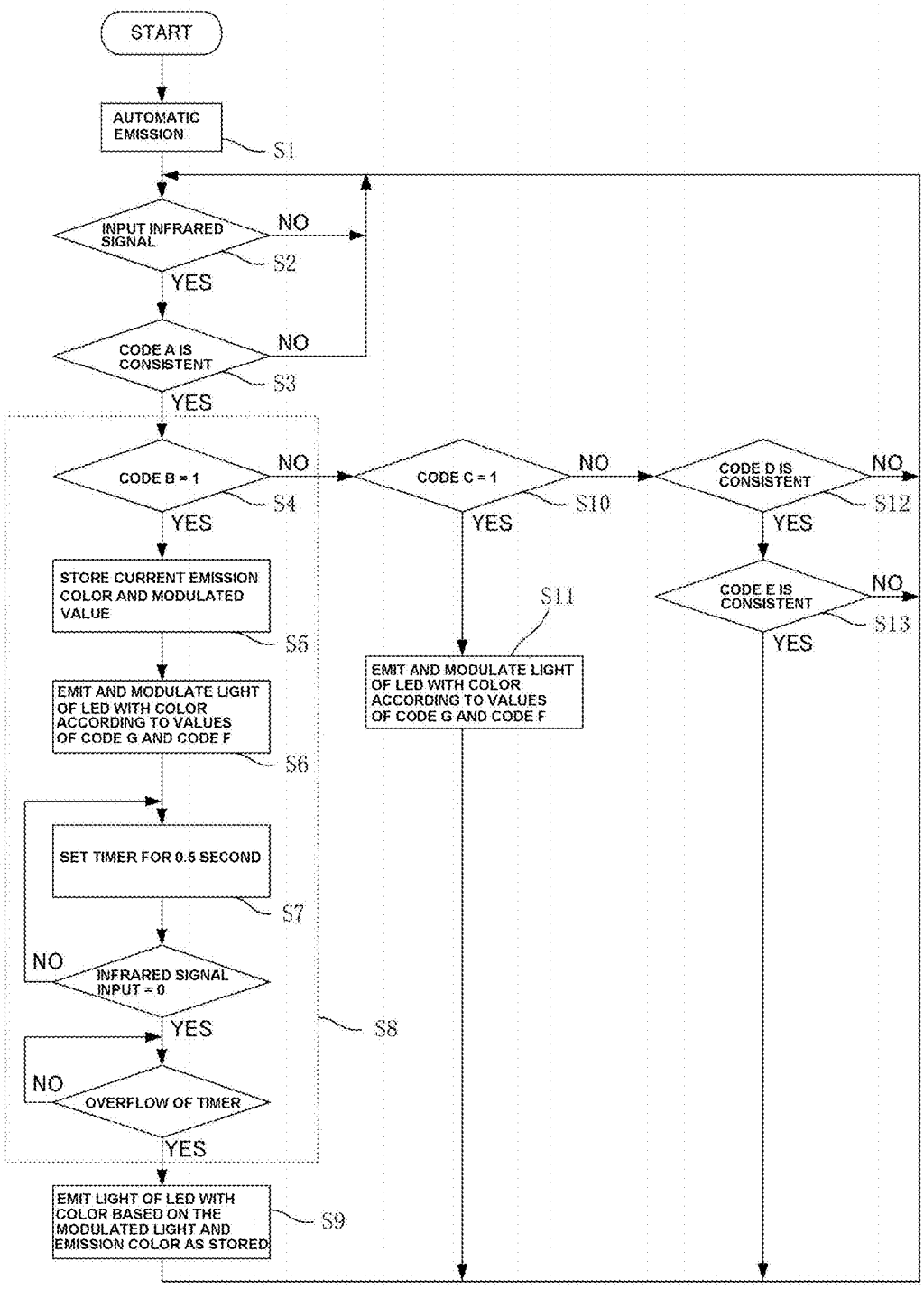
FIG. 17 is a flow chart illustrating control contents using the infrared signal.

The processes (S8) after light is emitted according to the emission color and modulated light value set in the step S6 upon determination of "the code B=1" (S4) until the process returns to a state before determining "the code B=1" entails, in actuality, complicated processes, although FIG. 17 shows a summarized description. The step S8 includes the processes until completing light emission associated with "the code B=1," and performs the processes corresponding to various conditions in various states, such as, where the light emitting device 103 can continuously receive "the code B=1," can sporadically receive, or can detect no infrared signal at all. The processes (S8) are to obtain stage effects as shown in FIGS. 18A, 18B.

Figure 18A:
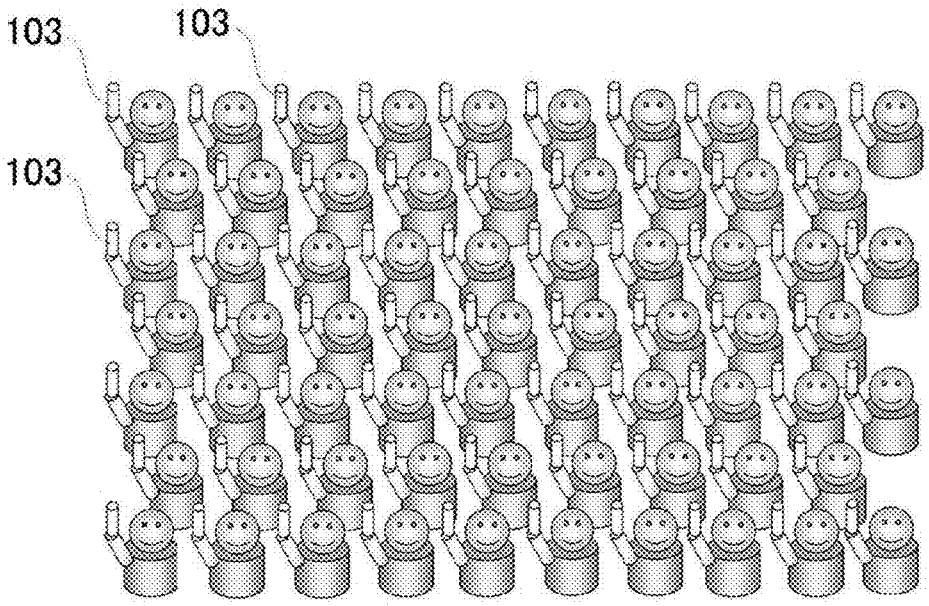
FIG. 18A is an explanatory view showing another example of a stage effect.
Figure 18B:
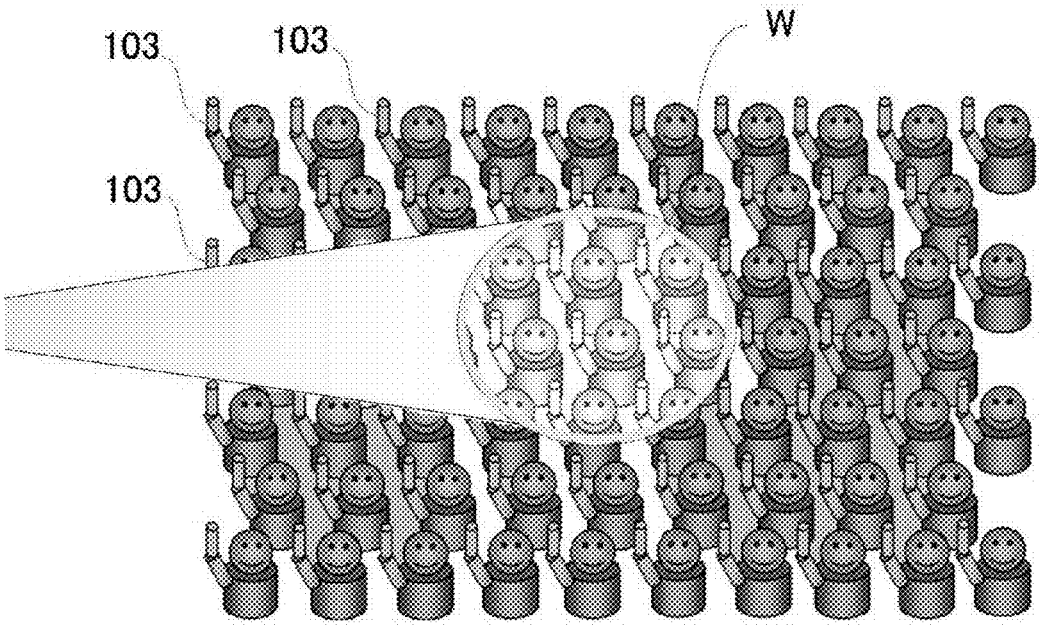
FIG. 18B is an explanatory view showing another example of a stage effect.

FIGS. 18A, 18B show spectators, each of those who holds the light emitting device 103 in one hand in a concert venue, as an example. FIG. 18A shows a state in which all of the light emitting devices 103 held by the spectators emit light in the same color and the same modulated light value, or a state in which light is switched off. Generally, the state is obtained by transmitting the control signal by the wide-area type light emitting instruction apparatus to the entire venue.

In the state in FIG. 18A, when the spectators are irradiated by the "spot-type" emitting apparatus provided separately, the control signal reaches only one partial area W as shown in FIG. 18B. Therefore, the light emitting devices 103 distributed over the venue are divided between the ones receiving the infrared signal from the "spot-type" emitting apparatus, and the others receiving no infrared signal. Only the light emitting devices 103 existing in the area W perform a predetermined light emission by the control code from the "spot-type" emitting apparatus. In the aforementioned example, the light emitting devices 103 emit light in a predetermined color only for 0.5 second upon receiving the infrared signal, and then, return to a state before the emission.

When the area W irradiated with the infrared signal by the "spot-type" emitting apparatus is continuously moved, the light emitting devices 103 existing in an area which changes according to the movement of the area W successively emit light in the predetermined color, and then, return to an original state in 0.5 second. As an effect represented for an stage effect, an area designated by the "spot type" emitting apparatus is lighted up with emission of the light emitting devices 103 as if being exposed by a spotlight, and, according to the movement of the area W, light like a persistence of vision is emitted just for a slight time in a lingering manner even after the area W is moved away. Thereafter, the light emitting devices 103 in that area are switched off or return to an original light emitting state.

The code B has the highest priority irrespective of the presence or absence of the codes C to E indicating an individual information (hard ID) of the light emitting device 103. Even when a plurality of different types of the light emitting devices 103 each having a different hard ID code exists, by determining "the code B=1," the code B is followed preferentially over a signal transmitted by the "spot-type" light emitting instruction apparatus 2, regardless of consistency or inconsistency of the hard IDs. The code B has the highest priority to be executed over the other control codes.

When "the code B=1" is not determined in the step S4, whether or not "the code C=1" (a hard ID of the light emitting device 103 is equal to the code C) is determined (S10). In the case of "the code C=1", light in a color matched with a value of the code G is turned on, and is modulated according to the contents of the code F (S11).

The code F, as a 3-bit data, enables brightness to be set at eight levels (from light-off to lighting at the maximum brightness level). The code G, also as a 3-bit data, modulates light of LEDs in three colors to emit light in eight different colors (red, green, blue, yellow, cyanogen, magenta, white, black (light-off)).

When "the code C=1" is not determined in the step S10, in order to further determine consistency with other hard IDs, it is determined whether or not a hard ID of the light emitting device 103 is consistent with "the code D" (S12) and it is determined whether or not a hard ID of the light emitting device 103 is consistent with "the code E" (S13).

Although not illustrated in the flow chart, processes which are executed in the case of the consistency with "the code D" or "the code E" may be appropriately provided. The process returns to the receivable state of the infrared signal (S2) upon completion of the processes.

On the other hand, when none of the hard IDs is consistent with the hard codes C to E, the process returns to the receivable state of the infrared signal (S2).

Figure 19A:
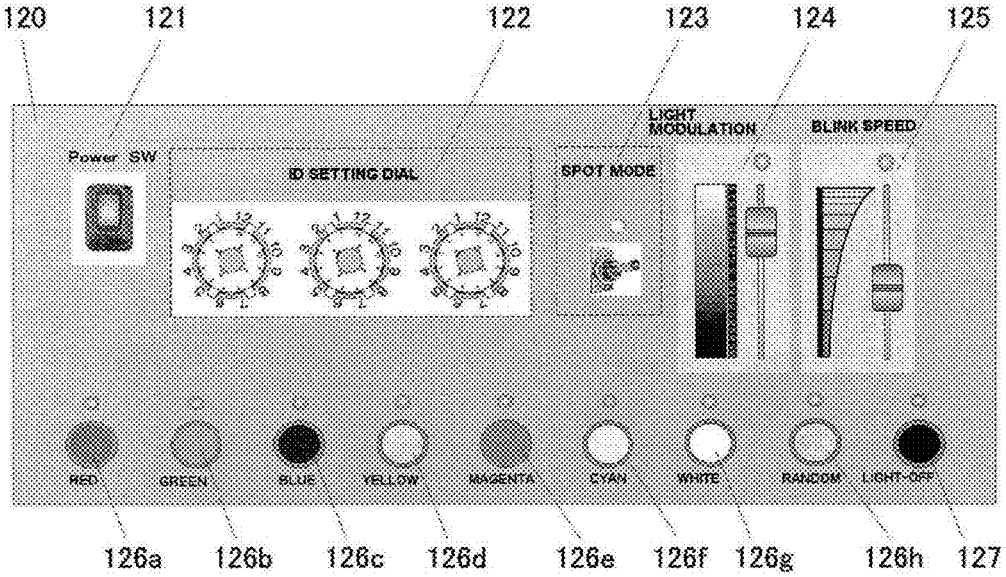
FIG. 19A is an explanatory view of a light emitting instruction apparatus according to the present invention.
Figure 19B:
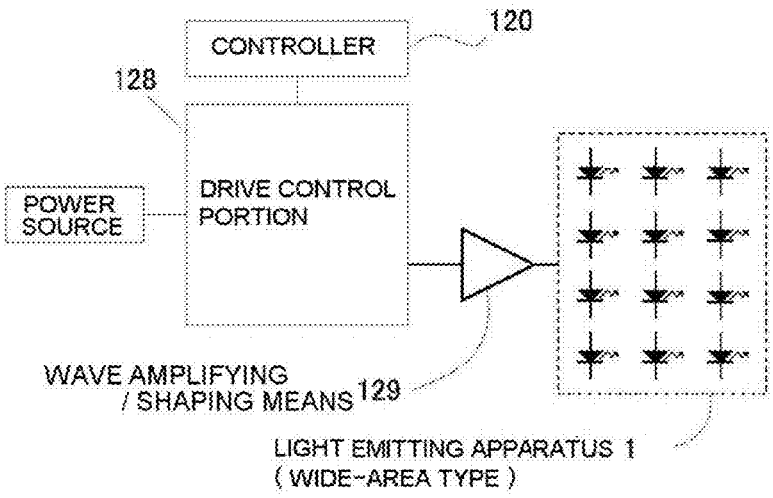
FIG. 19B is an explanatory view of the light emitting instruction apparatus according to the present invention.

Since spectators holding the light emitting devices 103 are distributed over a wide range in a large concert venue, the aforementioned emitting apparatus is used when all of the light emitting devices 103 held by the spectators are synchronized to emit light. FIG. 19A shows a panel surface of a controller 120 which operates the emitting apparatus. FIG. 19B is a block diagram showing an electric configuration of the emitting apparatus. It is configured with the emitting apparatus 1 having the plurality of light emitting diodes D mounted thereto, the controller 120 controlling the emitting apparatus 1, the drive control portion 128, and the wave amplifying/shaping means 129. Additionally, there may be a case when a plurality of emitting apparatuses is connected to a single controller, as needed, and is synchronized to control light emission.

The panel surface of the controller 120 is, as an example, provided with a power switch 121, an ID setting dial 122, a spotting mode on/off switch 123, a light modulating volume 124, a blink speed adjusting volume 125, an emission color instruction switches 126 (126*a*, 126*b*, 126*c*, 126*d*, 126*e*, 126*f*, 126*g*, 126*h*), and a light-off switch 127.

The ID setting dial 122 is an ID setting means used to set hard IDs, such as the codes C to E, as described above. By using each of the switches of the controller 120, the emitting apparatus performs settings in the light emitting device 103 for selecting an emission color, modulating the emission color, adjusting brightness, switching off light, adjusting a blink speed, and the like. After generating a control signal having the settings, the emitting apparatus generates a predetermined infrared signal to output the signal via the emitting apparatus.

Among examples of use of the emitting apparatus described above, as one usage, is to irradiate infrared ray from an upper side with respect to a planar area. On the other hand, in some of domed stadiums and gymnasium facilities, audience seats may be provided so as to be formed in a mortar shape. In such a case, a posture of the emitting apparatus may be changed such that infrared light in an elongated band shape in a vertical direction is irradiated from a vicinity of a center inside a space in the mortar shape. Then, the emitting apparatus is rotated through 360 degrees about an axis in a perpendicular direction to move a light emission area so as to circle around the audience seats in the mortar shape. Accordingly, the emitting apparatus according to the present invention allows the light emission area to be formed in a band shape, and makes it possible to perform a variety of stage effects.

The present invention is applicable to a control of a light emitting device to emit light upon receiving infrared ray, and to one of lighting equipment used for a stage effect in a concert, and the like.

What is claimed is:

1. An infrared signal emitting apparatus comprising:

an emitting apparatus main body for emitting infrared ray including control information to a light emitting device which emits light based on the received control information, the emitting apparatus main body includes a light source having a plurality of light emitting diodes arranged in a planar manner, the plurality of light emitting diodes generate the control information by emission of the infrared ray, a tubular nozzle having an opening is provided at a front side of the light source, and the opening is formed in a narrow shape in which a horizontal width is substantially greater than a vertical width, and the infrared ray generated by the light source is irradiated from the opening of the nozzle.

2. The infrared signal emitting apparatus according to claim 1, wherein the nozzle is detachably attached to the emitting apparatus main body.

3. The infrared signal emitting apparatus according to claim 1, wherein the nozzle has a fan shape spread toward a front side for adjusting width of infrared light emitted by the light.

4. The infrared signal emitting apparatus according to claim 1, wherein the nozzle is structured to be able to change the length.

5. The infrared signal emitting apparatus according to claim 1, further comprising a bracket to be used for suspension or placement of the emitting apparatus main body, wherein the emitting apparatus main body is rotatably provided with respect to the bracket.

6. The infrared signal emitting apparatus according to claim 1, further comprising a bracket to be used for suspension or placement of the emitting apparatus main body, wherein an attachment angle of the emitting apparatus main body with respect to the bracket is selected from a plurality of predetermined angles so as to allow the emitting apparatus main body to be fixed.

* * * * *